US007066460B2

(12) United States Patent
Asao

(10) Patent No.: US 7,066,460 B2
(45) Date of Patent: Jun. 27, 2006

(54) SHEET SUPPLY APPARATUS AND IMAGE FORMING APPARATUS HAVING THE SAME

(75) Inventor: Yusuke Asao, Yamanashi-ken (JP)

(73) Assignee: Nisca Corporation, Yamanashi-ken (JP)

( * ) Notice: Subject to any disclaimer, the term of this patent is extended or adjusted under 35 U.S.C. 154(b) by 440 days.

(21) Appl. No.: 10/397,238

(22) Filed: Mar. 27, 2003

(65) Prior Publication Data

US 2003/0209850 A1 Nov. 13, 2003

(30) Foreign Application Priority Data

Mar. 27, 2002 (JP) ..... 2002-088191
Mar. 27, 2002 (JP) ..... 2002-088319
Mar. 27, 2002 (JP) ..... 2002-088693

(51) Int. Cl.
*B65H 5/00* (2006.01)

(52) U.S. Cl. ..... 271/10.04; 271/4.03
(58) Field of Classification Search ..... 271/10.03, 271/4.03
See application file for complete search history.

(56) References Cited

U.S. PATENT DOCUMENTS 5,709,377 A * 1/1998 Yoshioka et al. ..... 271/9.02
2004/0114945 A1 * 6/2004 Takagi ..... 399/21

FOREIGN PATENT DOCUMENTS

JP 63-258344 * 10/1988
JP 5-333747 12/1993
JP 2001-302058 10/2001
JP 2003-261266 9/2003

OTHER PUBLICATIONS

Patent Abstract of Japan, Publication No. 05–057966, Publication date Mar. 9, 1993, Applicant Ricoh Co., Ltd.

Patent Abstract of Japan, Publication No. 02–008147, Publication date Jan. 11, 1990, Applicant Canon Inc.

Patent Abstract of Japan, Publication No. 10–293503, Publication date Nov. 4, 1998, Applicant Ricoh Co., Ltd.

* cited by examiner

*Primary Examiner*—Donald P. Walsh
*Assistant Examiner*—Kenneth W. Bower
(74) *Attorney, Agent, or Firm*—Manabu Kanesaka

(57) ABSTRACT

A sheet supply apparatus supplies a sheet to an image forming apparatus. The sheet supply apparatus includes a sheet loading device for loading the sheet, a sheet stacking device for stacking the sheet to be loaded on the sheet loading device, a sheet feeding device provided at a front end of the sheet loading device in a sheet supplying direction for feeding the sheet loaded on the sheet loading device, a sheet carrying device provided at a rear end of the sheet loading device in the sheet supplying direction for carrying the sheet stacked on the sheet stacking device into the sheet loading device, a sheet detecting device for detecting whether an image is formed on at least one side of the sheet loaded on the sheet loading device, and a supporting device for supporting the sheet loading device to be extractable from the apparatus.

26 Claims, 10 Drawing Sheets

Fig. 5(A)
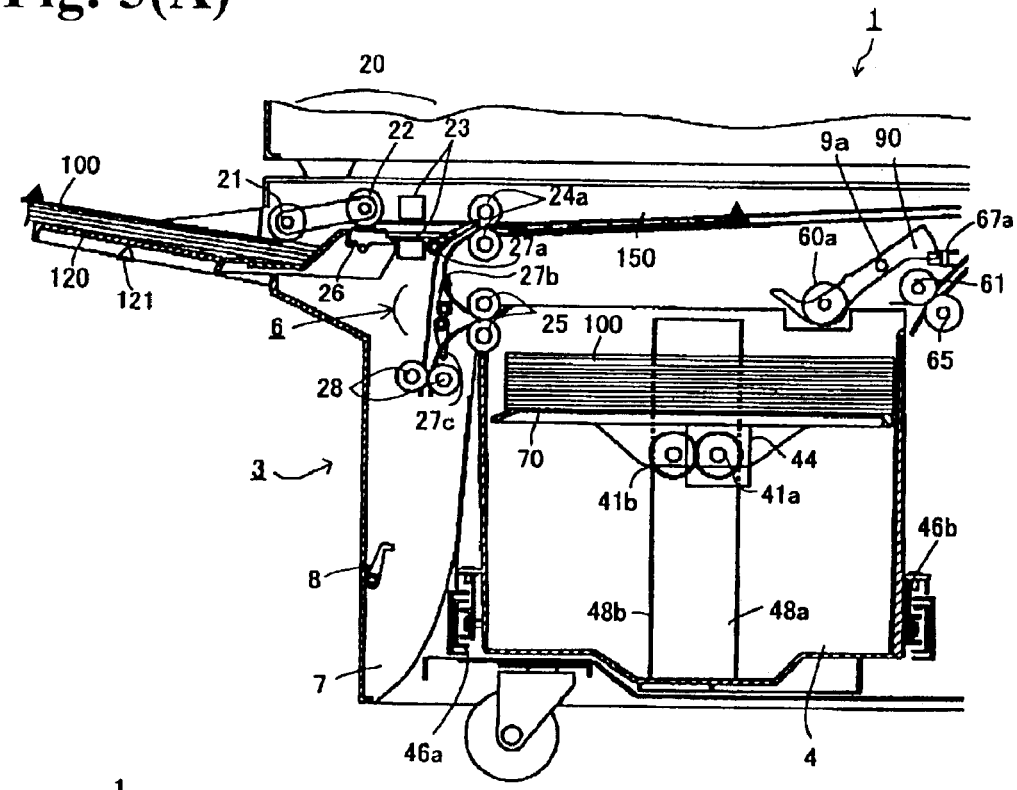
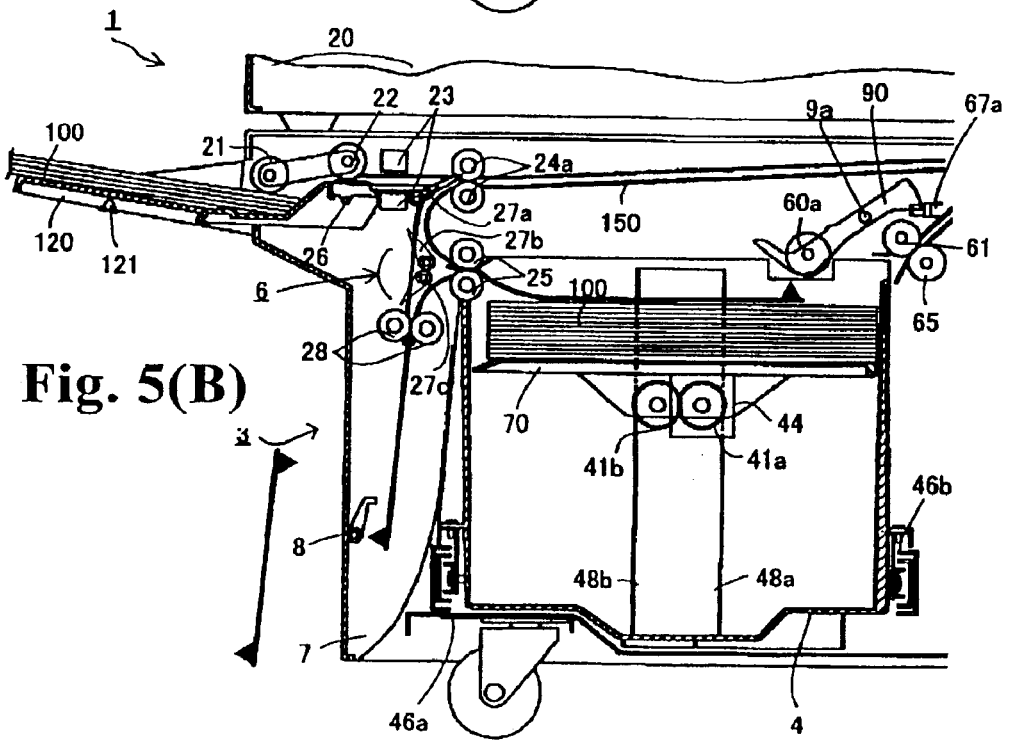
Fig. 5(B)

SHEET SUPPLY APPARATUS AND IMAGE FORMING APPARATUS HAVING THE SAME

BACKGROUND OF THE INVENTION AND RELATED ART STATEMENT

The present invention relates to a sheet supply apparatus and image forming apparatus, and particularly relates to a sheet supply apparatus for supplying sheets to an image forming apparatus, and an image forming apparatus having the sheet supply apparatus.

A conventional sheet supply apparatus supplies a sheet with an image on one side (the front side) having to an image forming apparatus such as a photocopier, printer, facsimile, or a like to form an image on the other face (the back side), thereby reducing the number of sheets to conserve resources arid reducing an impact on the environment.

As an example of such a sheet supply apparatus, Japanese Patent Publication No. 10-293503 has disclosed an automatic document feeder (ADF) mounted on an image forming apparatus for determining whether one side of a sheet stacked on the ADF can be used. In this technique, when it is determined that the sheet can be printed, the sheet is transported from the ADF to a supply device disposed at a bottom of the image forming apparatus through a reuse sheet transporting path formed in the image forming apparatus in a direction opposite to the sheet feeding direction of the supply device, and then the sheets are stacked on the supply device.

Also, Japanese Patent Publication No. 02-8147 has disclosed a supply device comprising detecting means disposed at downstream of a sheet stacker for detecting whether one side of a sheet is blank, thereby sorting the sheet as a reusable sheet or not. With this technique, the sheet with at least one reusable blank side (hereafter referred to as "reuse sheet") is automatically stacked with the blank side (reusable side) up.

Japanese Patent Publication No. 05-57966 has disclosed marking means for marking a side of the sheet with an image thereon to separate the sheet with an image thereon from the sheet which without an image. According to the technique disclosed in the Publication, without providing any special marking means, the image forming means can be used to mark the side of the sheet with an image thereon.

In Japanese Patent Publication No. 10-293503, the ADF and the supply device are arranged with the image forming apparatus in between. Therefore, it is necessary to arrange an internal configuration of the image forming apparatus to accommodate a reuse sheet transporting path from the ADF to the supply device through the image forming apparatus. Also, the reuse sheet is transported to be stacked within the supply device in a direction opposite to a direction that the reuse sheet is supplied from the supply device in the same path. Therefore, it is difficult to stack and supply the reuse sheet smoothly and quickly.

Also, in Japanese Patent Publication No. 02-8147, the disclosed supply device is used also as a sorting device for the reuse sheets, so the sheets need to first be stacked on a sheet stacker in the device before the sorting. Further, the device needs to have a discharge stacker for non-reusable sheets, thereby increasing a size of the supply apparatus.

Further, in Japanese Patent Publication No. 05-57966, the image forming apparatus has the marking means, so it is difficult to mark one side of the reuse sheet without changing the configuration of the image forming apparatus.

The present invention has been made in light of the above problems, and the first object of the invention is to provide a sheet supply apparatus and image forming apparatus wherein the reuse sheets can be stacked and supplied smoothly and speedily, while it takes a short period of time to replenish and exchange the sheets.

The second object of the present invention is to provide a compact sheet supply apparatus and an image forming apparatus having the sheet supply apparatus, wherein the reuse sheets can be stacked and supplied smoothly and speedily without changing the internal configuration of the image forming apparatus.

The third object of the present invention is to provide a sheet supply apparatus and an image forming apparatus having the sheet supply apparatus, wherein the reuse sheets can be loaded while being aligned, and also the side of the reuse sheet with no image thereon can be reliably used without mixing up with the side with an image thereon.

Further objects and advantages of the present invention will be apparent from the following description of the invention.

SUMMARY OF THE INVENTION

To achieve the above objects, according to the first aspect of the present invention, a sheet supply apparatus for supplying a sheet to an image forming apparatus comprises sheet loading means for loading the sheet; sheet stacking means externally exposed outside the device for stacking the sheet to be loaded on the sheet loading means; sheet feeding means disposed at a front end of the sheet loading means in a sheet supplying direction for feeding the sheet loaded on the sheet loading means; sheet carrying means provided at a rear end of the sheet loading means in the sheet supplying direction for carrying the sheet stacked on the sheet stacking means into the sheet loading means; first sheet detecting means for detecting whether an image is formed on at least one side of the sheet loaded on the sheet loading means; and supporting means for supporting the sheet loading means so as to be externally extracted from the device.

According to this configuration, the sheet stacked on the sheet stacking means outside the device is carried into the sheet loading means by the sheet carrying means provided at the rear end of the sheet loading means in the sheet supplying direction, while the first detecting means determines whether an image is formed on at least one side of the sheet.

The sheet feeding means provided at the front end of the sheet loading means in the sheet supplying direction feeds out the sheet loaded on the sheet loading means, and supplies the sheet to the image forming apparatus. Also, the supporting means supports the sheet loading means so as to be extracted from the device, so that a batch of the sheets can be replenished and exchanged.

The sheet feeding means is provided at the front end of the sheet loading means and the sheet carrying means is provided at the rear end of the sheet loading means in the sheet supplying direction. Accordingly, the sheet is carried in and supplied in only one direction relative to the sheet loading means, so that the sheet can be accumulated and supplied smoothly and speedily. Further, the supporting means supports the sheet loading means to be extracted from the device, so that a batch of the sheets can be replenished and exchanged in a short time. The sheet stacking means is exposed outside the device, thereby reducing a size of the device.

According to the second aspect of the present invention, an image forming apparatus has a sheet supply apparatus for supplying a sheet to the image forming apparatus for forming an image on the sheet. The sheet supply apparatus also serves as a stacking base for the image forming apparatus. The image forming apparatus comprises sheet loading means for loading the sheet; sheet stacking means for stacking the sheet to be loaded on the sheet loading means; sheet feeding means disposed at a front end of the sheet loading means in the sheet supplying direction for feeding the sheet loaded on the sheet loading means; sheet carrying means disposed at a rear end of the sheet loading means in the sheet supplying direction for carrying the sheet stacked on the sheet stacking means into the sheet loading means; first sheet detecting means for detecting whether an image is formed on at least one side of the sheet loaded on the sheet loading means; and supporting means for supporting the sheet loading means so as to be extracted from the device. The supporting means supports the sheet loading means so as to be extracted from an operating side of the image forming apparatus in a direction substantially perpendicular to the sheet supplying direction.

According to this configuration, the supporting means of the sheet supply apparatus supports the sheet loading means so as to be extracted from an operating side of the image forming apparatus in a direction substantially perpendicular to the sheet supplying direction. Therefore, there is a space at the operating side of the image forming apparatus for an operator to operate the apparatus, thereby securing a space for replenishing and exchanging unused sheets and reuse sheets, and making it easy to use the image forming apparatus.

Further, according to the third aspect of the present invention, a sheet supply apparatus for supplying a sheet to an image forming apparatus comprises a plurality of sheet loading means for loading the sheet; sheet stacking means exposed outside the device for stacking the sheet to be loaded on the sheet loading means; sheet feeding means provided at a front end of the sheet loading means in the sheet supplying direction for feeding the sheet loaded on the sheet loading means; sheet carrying means provided at the rear end of the sheet loading means in the sheet supplying direction for carrying the sheet stacked on the sheet stacking means into the sheet loading means; first sheet detecting means for detecting whether an image is formed on at least one side of the sheet loaded on the sheet loading means; reversing means disposed between the first detecting means and the sheet carrying means for selectively reversing a front and back side of the sheet according to a detection result of the first detecting means, and having a sheet reversing path disposed above the sheet loading means; and supporting means for supporting the sheet loading means so as to be extracted from the device. The sheet carrying means carries the sheet stacked on the sheet stacking means into the sheet loading means at a location closest to the sheet stacking means.

According to this configuration, in addition to the operations and advantages of the above-described aspects, the sheet carrying means carries the reuse sheet stacked on the sheet stacking means into the sheet loading means disposed at a location closest to the sheet stacking means, thereby reducing a length of the sheet carrying path of the sheet carrying means to minimize a sheet jam in the sheet carrying path.

The sheet supply apparatus may further comprise elevating means for raising and lowering the sheet loading means, and second detecting means for detecting whether the sheet is on the sheet stacking means. When the second detecting means detects the sheet, and the sheet feeding means are not operating, the elevating means lowers the sheet loading means by a predetermined amount, so that the sheet is carried to the sheet loading means, thereby eliminating an operational error regarding the carrying-in and supplying of the reuse sheets.

According to the fourth aspect of the present invention, a sheet supply apparatus for supplying a sheet to an image forming apparatus comprises: a plurality of sheet loading means for loading the sheet; sheet feeding means provided at a front side of the sheet loading means in the sheet supplying direction for feeding the sheet loaded on the sheet loading means; sheet carrying means for carrying in the sheet to one of the plurality of the sheet loading means; stacker means for stacking the sheet to be carried in by the sheet carrying means; sheet supply means for supplying the sheet stacked on the stacker means; detecting means disposed at downstream of the sheet supply means for detecting whether a front or back side of the sheet is blank; and reversing means disposed on a sheet transporting path between the detecting means and the sheet carrying means for selectively reversing the front and back side of the sheet. Each of the stacker means, the sheet supply means, the detecting means, and the reversing means are disposed at a side of the sheet loading means.

According to this configuration, the sheet supply means supplies the sheet stacked on the stacker means. Then, while the detecting means disposed at downstream of the sheet supply means detects whether the front or back side of the sheet is blank, the reversing means disposed on a sheet transporting path between the detecting means and the sheet carrying means selectively reverses the front and back side of the sheet. The sheet carrying means carries the sheet into one of the plurality of the sheet loading means to be loaded.

The sheet feeding means provided at the front end of the sheet loading means in the sheet supplying direction feeds the sheet loaded on the sheet loading means, and supplies the sheet to the image forming apparatus.

Accordingly, with this configuration, while the detecting means checks the front and back sides of the reuse sheet stacked on the stacker means, the sheet is loaded on the sheet loading means, and then the sheet feeding means feeds the reuse sheet. Thus, the reuse sheet can be supplied to the image forming apparatus without changing an internal configuration of the image forming apparatus. Further, each of the stacker means, sheet supply means, detecting means, and reversing means are disposed at the side of the sheet loading means, thereby making the overall device compact.

It is also acceptable that the reuse sheets are stacked on one of the sheet stacking means and unused sheets are stacked on the other of the sheet stacking means, so that an operator can select the reuse sheets and unused sheets according a preference or a request.

In addition to the configuration described above, the reversing means, detecting means, and sheet supply means may be disposed in this order at a rear side of the sheet supplying direction opposite to the sheet loading means provided with the sheet feeding means. The sheet feeding means is disposed at the front side of the sheet loading means in the sheet supplying direction, and the reversing means, detecting means, and sheet supply means are disposed at the rear side thereof. Therefore, the reuse sheet is carried in and fed out (supplied) to and from the sheet loading means in only one direction, thereby stacking and supplying the reuse sheet smoothly.

Also, guide means may be further provided for inserting and extracting the plurality of the sheet loading means in a direction perpendicular to the sheet feeding direction of the feeding means. With this configuration, it is possible to pull out the sheet loading means to replenish and/or exchange the sheet quickly when additional sheets are loaded on the sheet loading means or the reuse sheets are replaced with the unused sheets.

Further, the stacker means is disposed outside of the device, so that the reuse sheets can be easily set without opening or closing a door. It is not necessary to provide a space inside the device for the stacker means, thereby reducing a size of the device. The sheet carrying means carries the sheet into the sheet loading means disposed at a side of the stacker means. Accordingly, the reuse sheets is carried into the sheet loading means closer to the stacker means in the sheet carrying path by a shorter distance, thereby preventing a jam of the reuse sheet in the transporting path.

The plurality of the sheet loading means may be disposed in parallel along a longitudinal direction, or may be overlapped in a vertical direction. With this configuration, it is possible to limit a dimension of one of height and width, thereby reducing the size of the device. Also, a discharge unit may be further disposed at a side of the sheet loading means between the stacker means and the sheet loading means for discharging the sheet with the image on both sides. Accordingly, it is possible to sort the reuse sheets and non-reusable sheets, and stack/supply the reuse sheets reliably, thereby reducing the size of the device through an efficient use of the space.

Further, a sheet reversing path for the reversing means may be formed above the sheet loading means, and a sheet discharging path for the discharging means is formed at a side of the sheet loading means. According to this configuration, the sheet reversing path and the sheet discharging path are formed in the spaces above and the side of the sheet loading means, thereby reducing the size of the device. The discharge means discharges the non-reusable sheets to the sheet discharging path so that the supply device can stack and supply only the reuse sheets.

According to the fifth aspect of the present invention, an image forming apparatus has a sheet supply apparatus for supplying a sheet to the image forming apparatus for forming an image on the sheet. The sheet supply apparatus also serves as a stacking base for the image forming apparatus. The sheet supply apparatus comprises: a plurality of sheet loading means for loading the sheet; sheet feeding means provided at a front side of the sheet loading means in the sheet supplying direction for feeding the sheet loaded on the sheet loading means; sheet carrying means for carrying in the sheet to one of the plurality of the sheet loading means; stacker means for stacking the sheet to be carried in by the sheet carrying means; sheet supply means for supplying the sheet stacked on the stacker means; detecting means disposed at downstream of the sheet supply means for detecting whether a front or back side of the sheet is blank; and reversing means disposed on a sheet transporting path between the detecting means and the sheet carrying means for selectively reversing the front and back side of the sheet. Each of the means is disposed on the same frame in the sheet supply apparatus.

According to this configuration, the sheet supply apparatus serves as the stacking base for the image forming apparatus, and each of the means are disposed on the same frame. Therefore, both the sheet supply apparatus and the separate image forming apparatus can be installed on a smaller area. Further, the detecting means checks the front and back sides of the reuse sheets stacked on the stacker means while the sheets are loaded on the sheet loading means and the sheet feeding means feeds the reuse sheets, so that the reuse sheets can be supplied to the image forming apparatus without changing an internal configuration of the image forming apparatus.

According to the sixth aspect of the present invention, a sheet supply apparatus mounted on an image forming apparatus for supplying a sheet comprises: sheet loading means for loading the sheet; sheet feeding means for feeding the sheet loaded on the sheet loading means; supply means for supplying the sheets fed by the sheet feeding means to the image forming apparatus; sheet carrying means for carrying in the sheet to the sheet loading means; stacker means disposed outside of the device for stacking the sheet to be carried in by the sheet carrying means; sheet supply means for supplying the sheet stacked on the stacker means; first detecting means disposed at downstream of the sheet supply means for detecting whether a front or back side of the sheet is blank; reversing means disposed between the detecting means and the sheet carrying means for selectively reversing the front and back side of the sheet and for feeding the sheet to the sheet carrying means; and marking means for providing a mark on one side of the sheet indicating that the side is used. Each of the means except the stacker means is disposed within the device.

According to this configuration, the sheet supply means supplies the sheet stacked on the stacker means. Then, while the first detecting means disposed at downstream of the sheet supply means detects whether the front or back side of the sheet is blank, the reversing means disposed between the detecting means and the sheet carrying means selectively reverses the front and back side of the sheet. The sheet carrying means carries the sheet into the sheet loading means to be loaded. The sheet feeding means feeds the sheet loaded on the sheet loading means, and the sheet carrying means carries in the sheet to the image forming apparatus.

The marking means marks one side of the sheet supplied to the image forming apparatus indicating that the side of the sheet is used. The marking means may disposed on a sheet carrying path between the stacker means and the sheet loading means, so that the sheet is marked before being loaded on the sheet loading means. Also, the marking means may be disposed on a sheet supply path through which the supply means supplies the sheets, so that the sheet is marked when supplied to the image forming apparatus.

With this configuration, the detecting means checks the front and back sides of the reuse sheets stacked on the stacker means while the reversing means aligns reusable sides of the sheets and loads the sheets on the sheet loading means. The marking means marks the used side of the reuse sheets supplied from the sheet loading means to the image forming apparatus. Thus, it is possible to prevent mixing with the used sides of the sheets when the image forming apparatus forms a new image. Also, the stacker means are exposed outside of the device, thereby requiring no space for the stacking means and making the device small. Also, it is easy to set the reusable sheets without opening or closing a door or the like.

Further, the sheet supply apparatus may further comprise: elevating means for raising and lowering the sheet loading means, and second detecting means for detecting whether the sheet is on the stacker means. When the second detecting means detects the sheet, and the sheet feeding means is not operating, the elevating means lowers the sheet loading means by a predetermined amount. Thus, the sheet is carried into the sheet loading means when the sheet feeding means is not operating, thereby eliminating an operational error in carrying and supplying the reuse sheet.

According to the, seventh aspect of the present invention, a sheet supply apparatus for supplying a sheet to an image forming apparatus comprises: a plurality of sheet loading means for loading the sheet; sheet feeding means for feeding the sheet loaded on the sheet loading means; sheet carrying means for carrying in the sheet to one of the sheet loading means; stacker means for stacking the sheet to be carried in by the sheet carrying means; sheet supply means for supplying the sheet stacked on the stacker means; detecting means disposed at downstream of the sheet supply means for detecting whether a front or back side of the sheet is blank; reversing means disposed between the detecting means and the sheet carrying means for selectively reversing the front and back side of the sheet and for feeding the sheet to the sheet carrying means; and marking means for providing a mark on one side of the sheet indicating that the side is used. Each of the stacker means, sheet supply means, detecting means, and reversing means is disposed at one side of the sheet loading means to which the sheet is carried in by the sheet carrying means. The marking means is disposed at the other side of the sheet loading means.

According to this configuration, the plurality of the sheet loading means is provided, and the reuse sheet is loaded in one of them. Thus, in addition to the operations and advantages of the previous aspects, the sheet loading means can be separated for the reuse sheets and the unused sheets. Also, each of the stacker means, sheet supply means, detecting means, and reversing means is disposed at the one side of the sheet loading means where the sheet is carried by the sheet carrying means, while the marking means is disposed at the other side of the sheet loading means, thereby making the device small and light.

Further, the sheet stacked on the sheet stacking means is carried into the sheet loading means disposed at a location closest to the sheet stacking means, thereby reducing a distance of a sheet carrying path to minimize a sheet jam in the sheet carrying path.

According to the eighth aspect of the present invention, a sheet supply apparatus for supplying a sheet to an image forming apparatus comprises: first and second sheet loading means disposed in parallel for loading the sheet; first and second sheet feeding means for feeding the sheet loaded on the sheet loading means; a sheet supply path formed above the second sheet loading means for supplying the sheet fed by the first sheet feeding means to the image forming apparatus; sheet carrying means disposed at upstream of the first sheet feeding means in a sheet feeding direction for carrying in the sheet to the first sheet loading means; stacker means for stacking the sheet to be carried into the first sheet loading means; sheet supply means for supplying the sheet stacked on the stacker means; detecting means disposed at a downstream of the sheet supply means for detecting whether a front or back side of the sheet supplied is blank; reversing means disposed between the detecting means and the sheet carrying means for selectively reversing the front and back side of the sheet and for transporting the sheet to the sheet carrying means; and marking means disposed on the sheet supply path for providing a mark on one side of the sheet fed from the first sheet loading means to indicate that the one side is used.

According to this configuration, two sheet loading means are provided, and the sheet supply path is formed above the second sheet loading means for supplying the sheet fed by the first sheet feeding means to the image forming apparatus. Further, the marking means is disposed on the sheet supply path, and sheet carrying means is disposed at upstream pf the first sheet feeding means in the sheet feeding direction for carrying in the sheet to the first sheet loading means. Therefore, in addition to the operations and advantages of the previous aspects, it is possible to efficiently use a space within the device, thereby reducing a size of the device further.

According to the ninth aspect of the present invention, an image forming apparatus has a sheet supply apparatus for supplying a sheet to the image forming apparatus for forming an image on the sheet. The sheet supply apparatus comprises: sheet loading means for loading the sheet; sheet feeding means for feeding the sheet loaded on the sheet loading means; supply means for supplying the sheet fed by the sheet feeding means to the image forming apparatus; sheet carrying means for carrying in the sheet to the sheet loading means; stacker means for stacking the sheet to be carried in by the sheet carrying means; sheet supply means for supplying the sheet stacked on the stacker means; detecting means disposed at downstream of the sheet supply means for detecting whether a front or back side of the sheet is blank; reversing means disposed between the detecting means and the sheet carrying means for selectively reversing the front and back side of the sheet and for feeding the sheet to the sheet carrying means; and marking means for providing a mark on one side of the sheet indicating that the side is used. Each of the means is disposed on the same frame in the device.

According to the present invention, the sheet supply apparatus serves as the stacking base of the image forming apparatus, and the image forming apparatus is placed on the sheet supply apparatus. Therefore, the sheet supply apparatus and the image forming apparatus can be installed on a small area.

BRIEF DESCRIPTION OF THE DRAWINGS

FIGS. 5(A) and 5(B) are sectional views showing an operation of the photocopier according to the first embodiment in a case that sheets with images on front sides thereof are stacked on a reuse sheet stacker, wherein FIG. 5(A) is a view showing a slate that a trailing edge of the reuse sheet in a transporting direction is nipped between a pair of transporting rollers, and FIG. 5(B) is a view showing a state that the trailing edge of the reuse sheet in the transporting direction is nipped between a pair of carry-out rollers and between a pair of carry-in rollers;

FIGS. 6(A) and 6(B) are sectional views showing an operation of the photocopier according to the first embodiment in a case that sheets with images on back sides thereof are stacked on the reuse sheet stacker, wherein FIG. 6(A) is a view showing a state that a trailing edge of the reuse sheet in a transporting direction is nipped between a pair of transporting rollers, and FIG. 6(B) is a view showing a state that the reuse sheet is reversed and the trailing edge of the reuse sheet in the transporting direction is nipped between a pair of carry-in rollers;

FIGS. 8(A) and 8(B) are sectional views showing an operation of the photocopier according to the second embodiment in a case that sheets with images on front sides thereof are stacked on a reuse sheet stacker, wherein FIG. 8(A) is a view showing a state that a trailing edge of the reuse sheet in a transporting direction is nipped between a pair of transporting rollers, and FIG. 8(B) is a view showing a state that the reuse sheet is carried into the first sheet loading unit;

FIGS. 9(A) and 9(B) are sectional views showing an operation of the photocopier according to the second embodiment in a case that sheets with images on back sides thereof are stacked on a reuse sheet stacker, wherein FIG. 9(A) is a view showing a state that a trailing edge of the reuse sheet in a transporting direction is nipped between a pair of transporting rollers, and FIG. 9((B) is a view showing a state that the reuse sheet is reversed and carried into the first sheet loading unit.

DETAILED DESCRIPTION OF PREFERRED EMBODIMENTS

Hereunder, embodiments of the invention will be described in detail with reference to the accompanying drawings.

Figure 1:
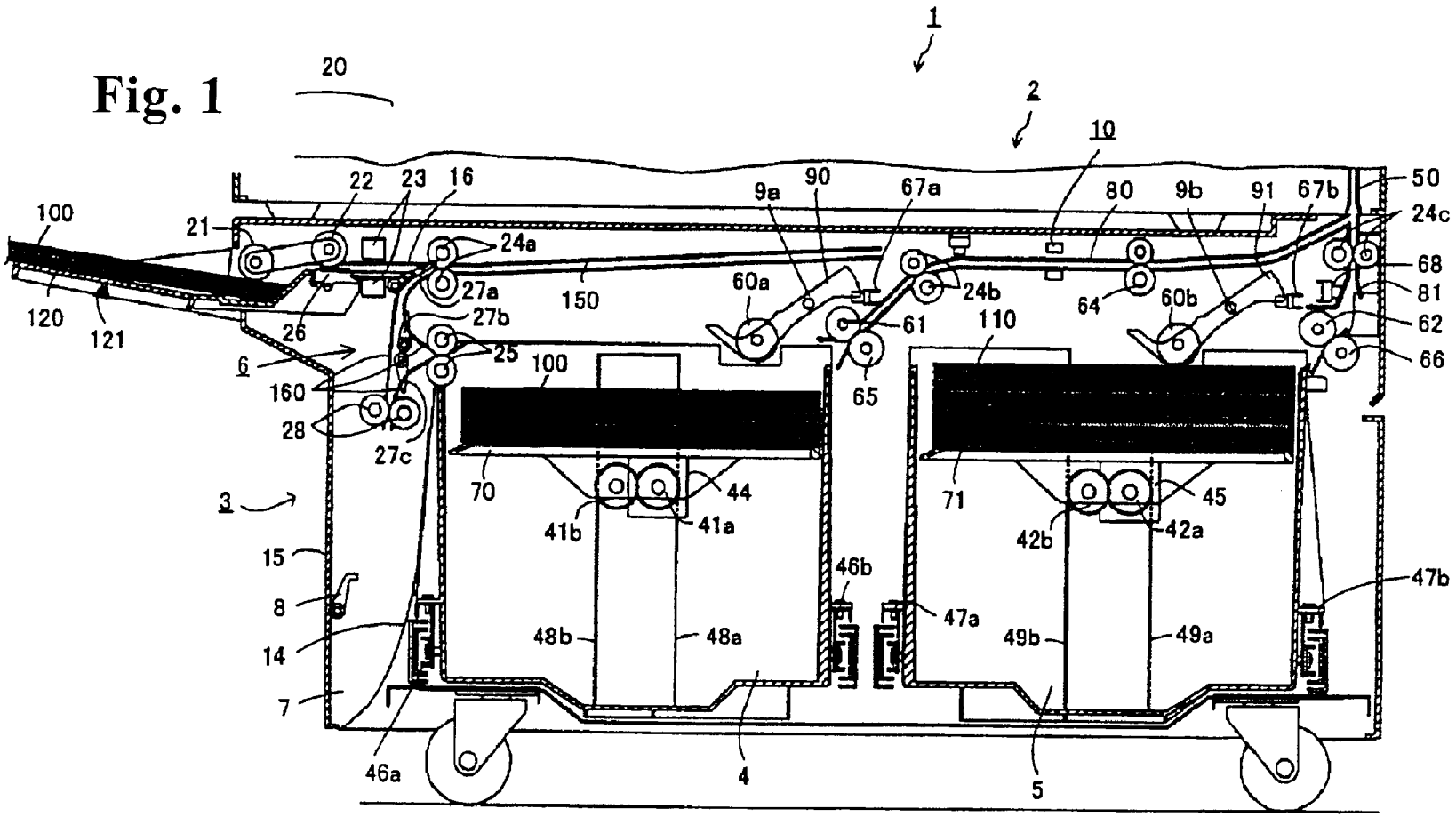
FIG. 1 is a sectional view of a photocopier of the first embodiment to which the present invention is applicable.

In the first embodiment, the present invention is applied Lo a photocopier as an image forming apparatus. As shown in FIG. 1, the photocopier 1 according to the present embodiment comprises a photocopier main unit 2 for forming images on sheets, and a sheet supply apparatus 3 for supplying the sheets one at a time to the photocopier main unit 2 and having a placement face for placing the photocopier main unit 2 thereupon.

The photocopier main unit 2 has a sheet carry-in guide 50 disposed generally vertically for carrying in sheets supplied from the sheet supply apparatus 3 toward a photosensitive drum disposed at the center portion of the photocopier main unit 2 for forming a latent image on a circumference thereof through an optical system. A pair of transporting rollers is disposed at upstream of the photosensitive drum for converting the transporting direction of the sheets transported in the vertical direction along the sheet carry-in guide 50 into the horizontal direction so as to transport the sheets toward the photosensitive drum. A sheet transporting path is formed within the photocopier main unit 2 in the horizontal direction, and the transporting roller pair is disposed at an entrance thereof.

A developing unit for developing the latent image formed on the photosensitive drum into a toner image, a cleaner for cleaning the photosensitive drum, an electrically-charged roller for providing a charge to the photosensitive drum for forming the latent image thereupon, and so forth, are disposed around the photosensitive drum. A transfer roller for pressing against the photosensitive drum with a sheet introduced therebetween is disposed at a position facing the photosensitive drum across the sheet transporting path to transfer the toner image formed on the circumference of the photosensitive drum onto the sheet. Also, a fixer having a heat roller and so forth for heating and fixing the toner image transferred onto the sheet is disposed at downstream of the photosensitive drum along the sheet transporting path. The operations of the units of the photocopier main unit 2 are controlled by a control unit (not shown) according to operation commands made by an operator using an operating unit (not shown) provided at an upper right portion on the front side thereof (toward the near side in the arrangement shown in FIG. 1).

The sheet supply apparatus 3 comprises a device frame 15 serving as a casing for the sheet supply apparatus 3 and front opening/closing doors at a front side of the device frame 15 (toward the near side in the arrangement shown in FIG. 1) for repair and inspection of mechanisms including the later-described components and control units or the like and for replenishing and exchanging the sheets. Reflection integral opening/closing sensors for detecting the open/close state of the front opening/closing doors are integrally provided near the front opening/closing doors. Also, multiple wheels contacting the floor are provided on the bottom of the device frame 15 for allowing the sheet supply apparatus 3 to move.

The sheet supply apparatus 3 has a first sheet loading unit 4 and a second sheet loading unit 5, formed in a box shape with an opening top so as to allow the sheets to be loaded therein, are disposed next to each other in the device frame 15. Reuse sheets 100 have one side with an image and the other blank side, which an image can be formed thereupon. The sheets are primarily loaded on the first sheet loading unit 4, and unused sheets 110 with blank both sides are primarily loaded on the second sheet loading unit 5. The first and second sheet loading units 4 and 5 have plate-shaped sheet loading tables 70 and 71 supported in the generally horizontal direction, respectively. The reuse sheets 100 are accumulated on the sheet loading table 70, and the unused sheets 110 are accumulated on the sheet loading table 71.

Figure 2:
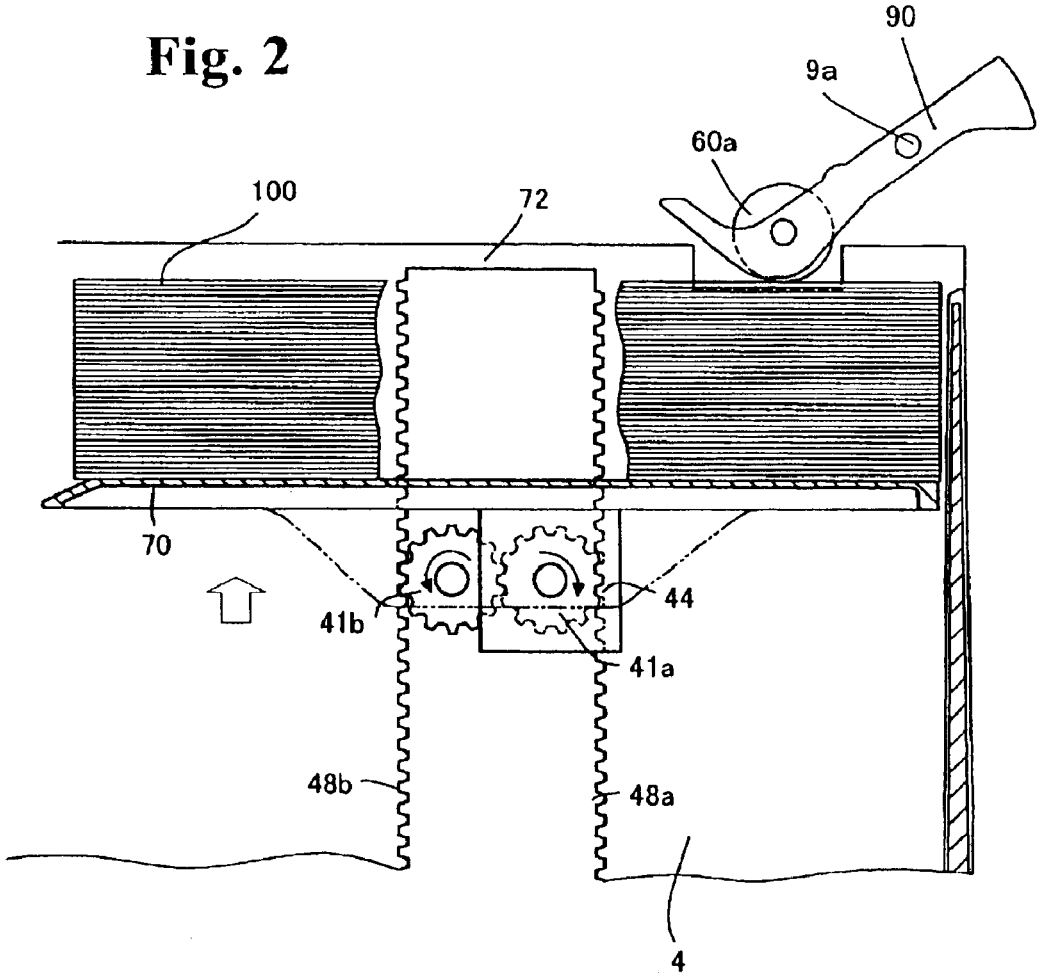
FIG. 2 is an enlarged sectional view around a sheet stacking table of the first sheet loading unit in the photocopier according to the first embodiment.

As shown in FIGS. 1 and 2, a thick plate-shaped back plate 72 is provided generally vertically at a backside of each of the first and second sheet loading units 4 and 5 (the far side in FIGS. 1 and 2). The center portion of the back plates 72 is notched out in a generally vertical rectangular shape extending to the base portion of the first and second sheet loading units 4 and 5. Elevating racks 48*a* and 48*b* and elevating racks 49*a* and 49*b* for elevating the sheet loading tables 70 and 71 are formed at the vertical notches, respectively.

Elevating motors 44 and 45 formed of stepping motors capable of forward and reverse rotations are fixed to the base of the sheet loading tables 70 and 71, by motor supporting members having a generally trapezoidal cross-sectional shape. Elevating gears 41*a* and 42*a* functioning as pinions are fixed to motor shafts of the elevating motors 44 and 45. The elevating gear 41*a* engages the elevating rack 48*a* and an elevating gear 41*b* having the same shape as the elevating gear 41*a*. The elevating gear 41*b* also serves as a pinion, and engages an elevating gear 48*b*.

Accordingly, as shown in FIG. 2, when the elevating gears 41*a* and 41*b* rotate in the direction indicated by the arrows through driving by the elevating motor 44, the sheet loading table 70 ascends generally vertically with the reuse sheets 100 loaded thereupon. When the elevating gears 41*a* and 41*b* rotate in the direction opposite to the arrows, the sheet loading table 70 descends generally vertically with the reuse sheets 100 loaded thereupon. The sheet loading table 71, elevating motor 45, elevating racks 49*a* and 49*b*, and elevating gears 42*a* and 42*b* are also assembled into such a rack-and-pinion structure. The motor supporting member has a switch button (not shown) provided thereupon at the near side in FIG. 1 for lowering the sheet loading tables 70 and 71 and replenishing or exchanging the reuse sheets 100 or unused sheets 110, so that the operator can lower the sheet loading tables 70 and 71 to an arbitrary position by pressing the switch button.

As shown in FIG. 1, slide guides 46*a*, 46*b*, 47*a*, and 47*b* are fixed at a lower position on both sides of the first and second sheet loading units 4 and 5, respectively. The slide guides contact and slide in an inner side and outer side of slide guide rails having a C-channel cross-sectional shape and supported by the device frame 15. Accordingly, the operator can open the front opening/closing doors and pull each of the first and second sheet loading units 4 and 5 out toward the near side in FIG. 1. Reflection integral load unit position detection sensors for detecting home positions of the first and second sheet loading units 4 and 5 are provided at a backside of the back plate 72 (the far side in FIG. 1), respectively.

Also, a pair of sheet carry-in rollers 25 for carrying the reuse sheets 100 into the first sheet loading unit 4 is disposed above one side of the first sheet loading unit 4 (the side of the later-described reuse sheet stacker 120). The sheet carry-in roller pair 25 is arranged so that the roller disposed at the top of the pair is a driving roller, and the roller disposed at the bottom presses against the driving roller as a slave roller. The other roller pairs described later have the same configuration (see FIG. 4). A transmitting integral sensor (not shown) is disposed near the slave roller of the sheet carrying roller pair 25 for determining a timing of carrying in the reuse sheets 100 to the first sheet loading unit 4. The second sheet loading unit 5 is primarily loaded with the unused sheets 110 as described above, and accordingly does not have this configuration.

A reuse sheet stacker 120 for stacking the reuse sheets 100 is disposed with an inclined angle at outside of the device frame 15 above the first sheet loading unit 4. The stacker has a base thereof supported by the device frame 15 and a stacking portion for stacking the reuse sheets 100 exposed from the device frame 15. A reflection integral empty sensor 121 for detecting whether the reuse sheets 100 are stacked (i.e., whether the reuse sheets exist) is disposed at the bottom center of the stacking portion of the reuse sheet stacker 120. Aligning plates having a generally triangular shape are movably fixed in the width direction of the reuse sheet stacker 120 so as to align the reuse sheets 100 stacked thereupon in the width direction.

A sheet supply unit 20 for supplying the reuse sheets 100 stacked on the reuse sheet stacker 120 into the device frame 15 is disposed above the base of the reuse sheet stacker 120. The sheet supply unit 20 comprises a kick roller 21 for feeding out the uppermost reuse sheet 100 stacked on the reuse sheet stacker 120; a supply roller 22 fitting in a roller shaft rotatably supported by the device frame 15 for supplying the reuse sheets 100 toward downstream; and a rubber separating pad 26 having friction capable of separating the reuse sheets 100 one at a time and disposed at a position so as to contact a circumference of the supply roller 22.

Connecting plates having a long plate shape are provided on both ends of the supply roller 22 and the kick roller 21. Each of the connecting plates has one side axially supported by the roller shaft of the supply roller 22, and the other side being rotatable. The roller shaft of the kick roller 21 is disposed on the other side of the connecting plates, and the kick roller 21 is fitted in the roller shaft. Also, pulleys (not shown) are fixed on the roller shafts of the kick roller 21 and the supply roller 22, respectively, and endless belts (not shown) are strung between the pulleys. Accordingly, the kick roller 21 rotates on the roller shaft of the supply roller 22 due to its own weight and contacts the uppermost reuse sheet 100 stacked on the reuse sheet stacker 120, thereby feeding out the uppermost reuse sheet 100 due to the rotating driving force supplied from the supply roller 22 side. The reuse sheet 100 fed out by the kick roller 21 is separated from the other sheets by the friction of the separating pad 26, and is supplied toward downstream by the supply roller 22.

A horizontal guide 16 for guiding the reuse sheet 100 in the horizontal direction is disposed at downstream of the supply roller 22 and the separating pad 26. Detection sensors 23 formed of line sensors such as CCDs or the like are disposed both above and below the horizontal guide 16 for detecting whether the front and back face of the reuse sheet 100 supplied by the supply roller 22 is blank. The detection sensors 23 are arranged at positions somewhat offset vertically with the horizontal guide 16 therebetween, and serve also as sensors for detecting a trailing edge of the reuse sheet 100 in the transporting direction transported through the horizontal guide 16.

A front/back reversing unit 6 for selectively reversing the front and back of the supplied reuse sheet 100 is disposed at downstream of the horizontal guide 16. The front/back reversing unit 6 comprises a reversal assistance guide 150 positioned above the first sheet loading unit 4 and forming a part of a reversal path for the reuse sheet 100; a reversal carry-out guide 160 positioned at a side of the first sheet loading unit 4 and connected to the horizontal guide 16 to form a part of the reversal path for the reuse sheet 100 and also form a discharge path for the reuse sheet 100; a pair of transporting rollers 24*a* disposed between the horizontal guide 16 and the reversal assistance guide 150 and also directly above the sheet carry-in roller pair 25; a pair of carry-out rollers 28 disposed at a bottom of the reversal carry-out guide 160; and first through third flappers 27*a*, 27*b*, and 27*c* having wedge-shaped tips for restricting the transportation direction of the reuse sheet 100 within the front/back reversing unit 6. For the carry-out roller pair 28, a roller toward the first sheet loading unit 4 is a driving roller, and a roller toward the reuse sheet stacker 120 is a slave roller (see FIG. 4).

The reversal assistance guide 150 is provided with an inclined angle in order to avoid interfering with a later-described feeding lever 90. The reversal carry-out guide 160 is comprised of three components, namely a first guide piece having an upper side formed in an arc shape and linking to a lower side guide piece of the horizontal guide 16 in an acute angle, and a lower side extending to the slave roller of the carry-out roller pair 28; a second guide piece formed in a generally U-shape and having an upper side disposed along an upper side of the first guide piece for guiding the reuse sheet 100 from the slave roller of the transporting roller pair 24*a* to the driving roller of the sheet carry-in roller pair 25; and a third guide piece formed in an arc shape for guiding the reuse sheet 100 between the slave roller or the carry-in roller pair 25 and the driving roller of the carry-out roller pair 28.

The first flapper 27*a* is disposed between the lower side guide piece of the horizontal guide 16 and the first guide piece of the reversal carry-out guide 160, so as to move between a position for closing the horizontal guide 16 (hereafter referred to the "horizontal guide closing position") and a position for closing a sheet carry-out path formed by a first guide piece and second guide piece through which the reuse sheet 100 is transported downward (hereafter referred to as "carry-out path closing position"). The second and third flappers 27*b*, 27*c* are disposed between the sheet carry-in roller pair 25 and the first guide piece, and can move between a position for guiding the loading tip of the reuse sheet 100 to the carry-out roller pair 28 side (the state shown in FIG. 1, hereafter referred to as "carry-out path guide position") and a position for guiding the reuse sheet 100 to the carry-in roller pair 25 side (see FIG. 5(B), hereafter referred to as "carry-in roller guide position"). Normally, the first flapper 27*a* is situated at the carry-out path closing position, and the second and third flappers 27*b* and 27*c* are situated at the carry-out path guide position.

On a side of the first sheet loading unit 4 (side toward the reuse sheet stacker 120) is formed a partition plate 14 with a curved lower side extending from around the carry-out roller pair 28 to the bottom plate of the device frame 15. Along with a side face of the device frame 15, the partition plate 14 forms a discharge sheet stacker 7 for storing the reuse sheets recorded on both sides and discharged from the carry-out roller pair 28 side. A discharge sheet depressor 8 for pressing the reuse sheets recorded on both sides toward the partition plate 14 by a spring (not shown) is fixed to the side of the device frame 15 facing the partition plate 14. Also, a side opening/closing door (not shown) is provided at the side of the device frame 15 facing the partition plate 14, so that the reuse sheets recorded on both sides and stored in the discharge sheet stacker 7 can be discharged by opening the side opening/closing door with a knob (not shown) fixed at a position higher than the discharge sheet depressor 8.

Feeding rollers 60*a* and 60*b* are provided above the first and second sheet loading units 4, 5 for contacting the uppermost reuse sheet 100 and uppermost unused sheet 110 loaded on the first and second sheet loading units 4 and 5 (see FIG. 4), so as to feed the sheets in the sheet supply direction of the photocopier main unit 2. The position where the feeding roller 60*b* is disposed relative to the second sheet loading unit 5 is a position somewhat toward the center (toward the left in FIG. 1) as compared to the position where the feeding roller 60*a* is disposed relative to the first sheet loading unit 4, in order to reduce a width of the sheet supply apparatus 3.

The roller shafts of the feeding rollers 60*a* and 60*b* are rotatably and axially supported by feeding levers 90 and 91 having a generally L-shaped cross-section and rotatable on the supporting shafts 9*a* and 9*b* axially supported by the device frame 15. The opposite ends of the L-shaped feeding levers 90, 91 with the supporting shaft 9*a* in between have an arc-shaped cross-section. Reflection integrated feeding roller position sensors 67*a* and 67*b* facing the arc-shaped end portions are disposed near the arc-shaped end portions of the feeding levers 90 and 91, respectively, for detecting the feeding rollers 60*a* and 60*b* in binary form, i.e., in the form of "on" and "off". That is, when the feeding rollers 60*a* and 60*b* contact the uppermost sheets, the arc-shaped end portions of the feeding levers 90 and 91 reflect light from the roller position sensors 67*a* and 67*b*, so the output signals of the roller position sensors 67*a* and 67*b* are on.

A sheet supply guide 80 communicating with a sheet carry-in guide 50 of the photocopier main unit 2 from a side opposite to the sheet carry-in roller pair 25 above the first sheet loading unit 4 is disposed above the second sheet loading unit 5, thereby forming a supply path for supplying the reuse sheets 100 loaded on the first sheet loading unit 4 to the photocopier main unit 2.

On the sheet supply guide 80, there are disposed a supply roller 61 disposed at upstream (on the lower side) for supplying the reuse sheets 100 fed by the feeding roller 60*a* toward downstream in the supply direction; a separating roller 65 pressed against the supply roller 61 for separating the reuse sheets 100 one at a time; a pair of transporting rollers 24*b* comprising a driving roller and a slave roller pressed against the driving roller for further transporting the reuse sheets 100 supplied thereto toward downstream in the supply direction; a transmitting integral sensor disposed around a position at downstream of the transporting roller pair 24*b* for detecting the leading edge of the reuse sheet 100 in the transporting direction; a stamp unit 10 for marking the image recording face of the reuse sheets 100 to indicate that the sheet side is used (as described later); and a pair of resister rollers 64 comprising a driving roller and a slave roller pressed against the driving roller for correcting skew of the reuse sheets 100 and supplying the reuse sheets 100 to the sheet transporting guide 50 of the photocopier main unit 2.

Figure 3:
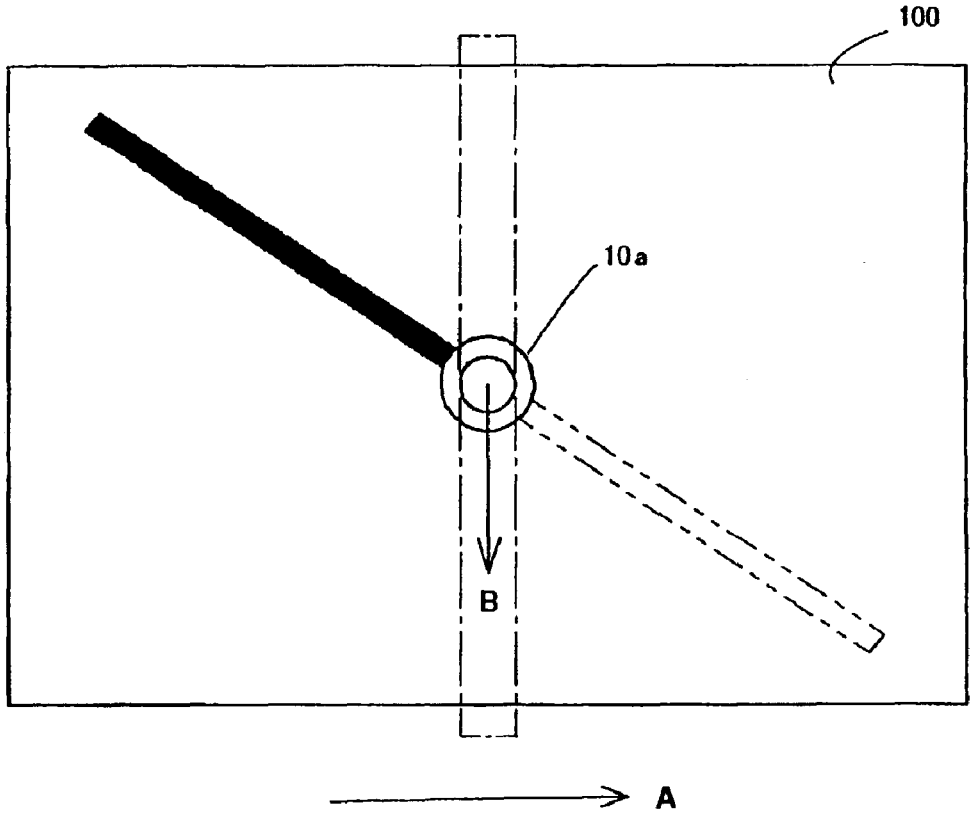
FIG. 3 is a plan view showing a stamp unit of the photocopier according to the first embodiment.

The stamp unit 10 is configured of a pinion receiving driving force from a stamp motor 35 (see FIG. 4) through a gear (not shown); a rack engaging the pinion so as to be movable; a quick-drying marker fixed on the rack and having an opening/closing plate at a tip thereof; and a marker receptacle fixed on the lower guide piece of the sheet supply guide 80 for receiving the marker. The marker receptacle has claws on both side for opening and closing the opening/closing plate of the marker. As shown in FIG. 3, the stamp unit 10 is configured such that, when reuse sheet 100 is supplied on the sheet supply direction (the direction of the arrow A), a marker 10*a* with opened the opening/closing plate at the tip of the marker receptacle moves in a transverse direction to the sheet supply direction (the arrow direction B), so as to mark the reuse sheet 100.

As shown in FIG. 1, a sheet supply guide 81 communicates with the sheet carry-in guide 50 of the photocopier main unit 2, and forms a supply path for supplying the unused sheets 110 loaded on the second sheet loading unit 5 to the photocopier main unit 2. The sheet supply guide 81 is disposed generally vertically above a side of the second sheet loading unit 5, and merges with the sheet supply guide 80 near a top of the device frame 15 so that the path has a forked shape.

On the sheet supply guide 81, there are provided a supply roller 62 disposed at upstream (on the lower side) for supplying the unused sheets 110 fed by the feeding roller 60*b* toward downstream in the supply direction (upwards); a separating roller 66 pressed against the supply roller 62 for separating the unused sheets 110 one at a time; a transmitting integral sensor 68 disposed around a position at downstream of the supply roller 62 for detecting the leading edge of the unused sheets 110 in the transporting direction; and a pair of resister rollers 24*c* comprising a driving roller and a slave roller pressed against the driving roller for correcting skew of the unused sheets 110 and supplying the unused sheets 110 to the sheet transporting guide 50 of the photocopier main unit 2.

Figure 4:
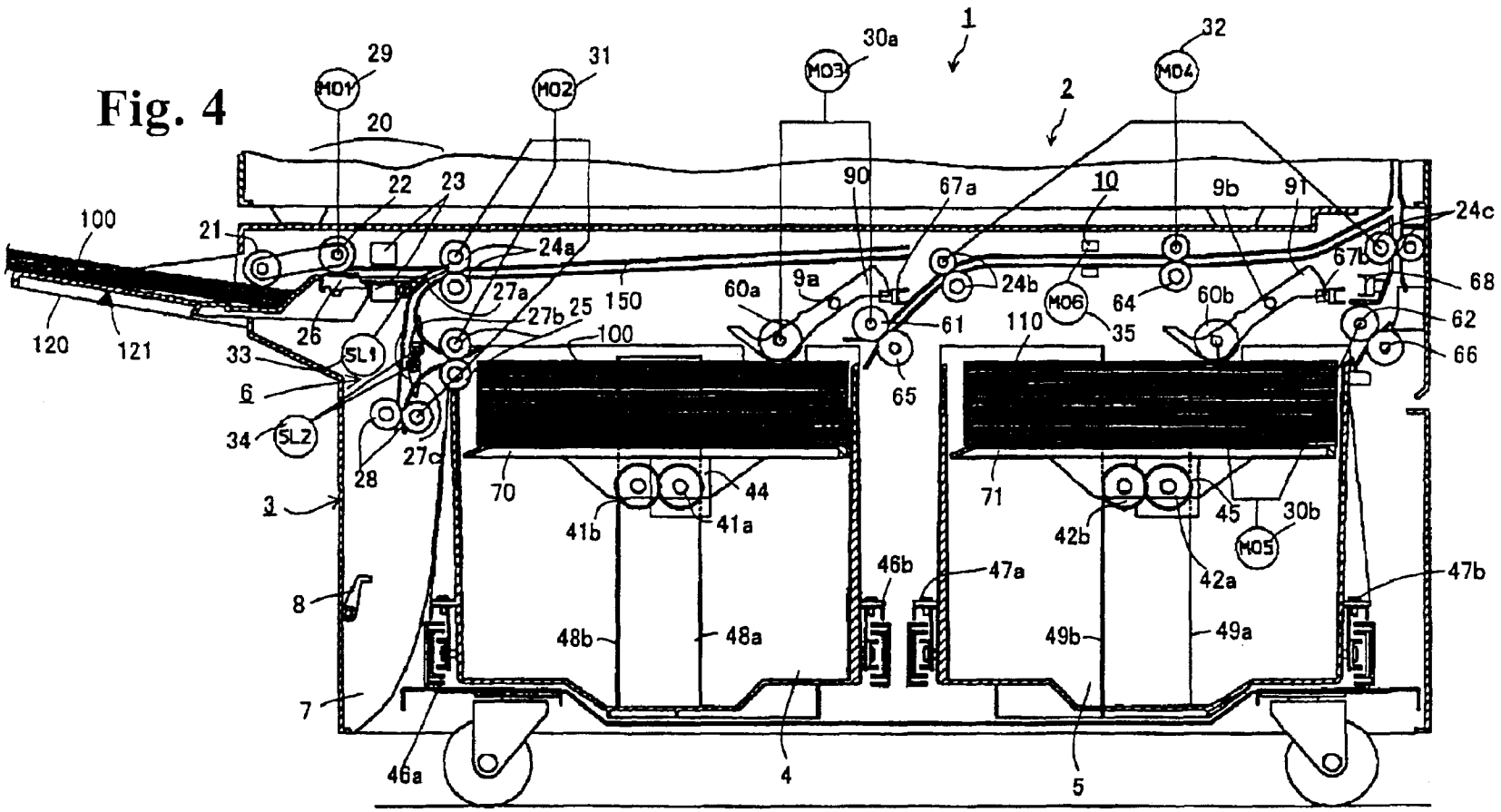
FIG. 4 is a sectional view showing a relation between a roller and an actuator of the photocopier according to the first embodiment.

As shown in FIG. 4, in addition to the above-described elevating motors 44 and 45 and the stamp motor 35, the sheet supply apparatus 3 has a supply motor 29 for rotating the supply roller 22 (and the kick roller 21); a transporting motor for rotating the driving rollers corresponding to each of the transporting roller pair 24*a*, the sheet carry-in roller pair 25 and the carry-out roller pair 28; a supply motor 30*a* for rotating the feeding roller 60*a* and the supply roller 61; a supply motor 30*b* for rotating the feeding roller 60*b* and the supply roller 62; and a supply motor 32 for rotating the driving rollers corresponding to each of the transporting roller pair 24*b*, the resister roller pairs 64 and 24*c*. These motors are stepping motors, in which the elevating motors 44, 45, the transporting motor 31, and the stamp motor 35 are capable of rotating in forward and reverse directions. The first flapper 27*a* is mechanically connected to a plunger of a solenoid 33, and the second and third flappers 27*b* and 27*c* are mechanically connected to a plunger of a solenoid 34, through connecting members (not shown).

A reverse clutch (not shown) is interposed in the roller shaft of the driving roller of the sheet carry-in roller pair 25, so that the driving roller of the sheet carry-in roller pair 25 rotates in the same direction regardless of the rotational direction of the transporting motor 31. Also, connection clutches (not shown) are interposed between the supply motor 32 and the driving rollers of the resister roller pairs 64 and 24*c*, so that the resister roller pairs 64 and 24*c* are driven by rotations from the supply motor when the connection clutch is engaged.

The sheet supply apparatus 3 has a control unit (not shown) with a CPU block for controlling the sheet supply apparatus 3. The CPU block comprises a CPU (central processing unit), ROM storing basic control programs for the sheet supply apparatus 3, RAM serving as a work area for the CPU, and an internal bus connecting these components. An external bus is connected to the CPU block. Connected to the external bus are a driver control section for controlling motor drivers for driving each of the stepping motors described above; an actuator control unit (not shown) including a solenoid control section for controlling solenoids 33, 34, and a clutch section for controlling engagement of each of the clutches; a sensor signal reception unit for receiving signals from each of the above described sensors; a power source control unit for controlling supply of a DC power source converted from a commercial AC power source at a power source (not shown) to the actuator control unit; and an interface for performing exchanging of the signals with the control unit of the photocopier main unit 2.

Next, operations of the photocopier 1 according to the present embodiment will be described primarily around the CPU of the control unit, in the order of an operation of carrying the reuse sheets 100 to the first sheet loading unit 4, an operation of supplying the sheets to the photocopier 2, and an operation of replenishing or exchanging the sheets.

Operation of Carrying the Sheet to the First Sheet Loading Unit

The CPU stands by until an empty sensor 121 turns on, i.e., until reuse sheets 100 are stacked on the reuse sheet stacker 120. When the empty sensor 121 turns off, it is determined whether the supply motor 30*a* for driving the feeding roller 60*a* is driving.

If it is the case, the flow waits until the supply motor 30*a* stops. If it is not the case, the feeding roller 60*a* is in contact with the uppermost reuse sheet 100 loaded on the first sheet loading unit 4, so the elevating motor 44 lowers the sheet loading table 70 by a predetermined amount (around 10 mm or so, an amount for the reuse sheet 100 to be carried in) by driving the elevating gears 41*a* and 41*b* in a direction opposite to the arrow direction in FIG. 2, and the motor stops. Thus, the reuse sheet 100 stacked on the reuse sheet stacker 120 is in a state capable of being carried into the first sheet loading unit.

Figure 6A:
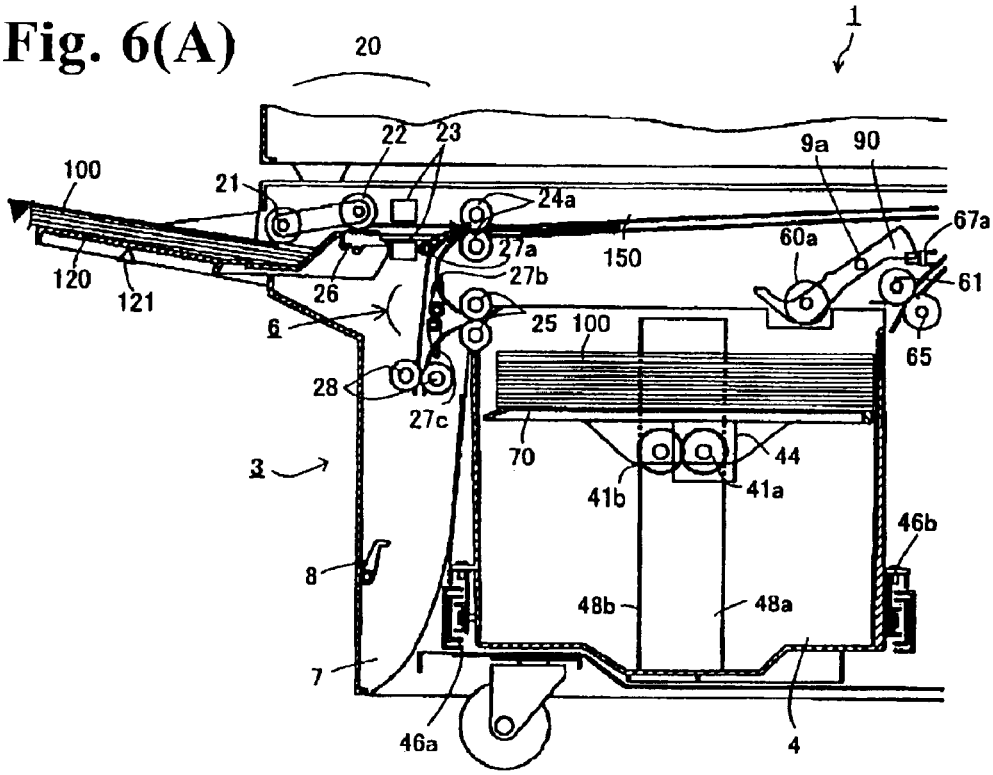

After driving the supply motor 29 and the transporting motor 31 to transport the reuse sheet 100 toward downstream by a predetermined distance, the motors are stopped. Thus, the uppermost reuse sheet 100 stacked on the reuse sheet stacker 120 is fed out with the kick roller 21, separated into an individual sheet with the supply roller 22 and the separating pad 26, carried into the horizontal guide 16, and transported toward downstream through the reversal assistance guide 150 by the transporting roller pair 24*a* by a distance somewhat shorter than the length of the reuse sheet 100. The rotations of the kick roller 21, supply roller 22, and transporting roller pair 24*a* stop in a state that the trailing end of the reuse sheet 100 in the transporting direction is nipped by the transporting roller pair 24*a*, as shown in FIG. 5(A) and FIG. 6(A). Such a nipping position can be measured by counting a predetermined number of steps (pulses) with regard to the rotations of the transporting motor 31 after the detection sensor 23 detects the trailing end of the reuse sheet 100 in the transportation direction. Note that the first flapper 27*a* is positioned at the carry-out path closing position to assist the leading edge of the reuse sheet 100 in the transportation direction to be nipped by the transporting roller pair 24*a*. In FIGS. 5(A) through 6(B), black triangles on the reuse sheets 100 indicate faces with images (the same in the FIGS. 8(A) through 9(B)).

During this time, the CPU measures the number of pixels in the image recorded on both sides of the reuse sheet 100 through an input from the detection sensor 23. When the number of pixels is greater than a predetermined value, it is determined that the face is recorded with an image. When the number of pixels is less than the predetermined value, it is determined that the face is blank. Accordingly, the CPU can judge whether the upper face, lower face, both faces, or neither of the faces of the reuse sheet 100 transported through the horizontal guide 16 is blank. When the detection sensor 23 detects the trailing end of the reuse sheet 100 in the transporting direction, the CPU stops the driving of the supply motor 29.

Next, as shown in FIGS. 5(A) and 5(B), when the upper face of the reuse sheet 100 is recorded upon and the lower face thereof is blank, or when both faces of the reuse sheet 100 are recorded, the solenoid 33 is turned on so that the first flapper 27*a* moves from the carry-out path closing position to the horizontal guide closing position. The solenoid 34 is left off while the second and third flappers 27*b* and 27*c* are maintained in the carry-out path guide position, and in this state, the transporting motor 31 is driven in reverse by a predetermined number of steps. The reverse rotation of the transporting motor 31 causes the carry-out roller pair 28 to nip the reuse sheet 100 and transport the reuse sheet 100 downward toward the discharge sheet stacker 7. The second and third flappers 27*b* and 27*c* in the carry-out path guide position assist the leading edge of the reuse sheet 100 in the transporting direction to be nipped by the transporting roller pair 28.

In the event that both sides of the reuse sheet 100 are recorded, the transporting motor 31 is driven in reverse by the number of steps sufficient for the trailing edge of the reuse sheet 100 in the transportation direction to be released from the transporting roller pair 28 and to fall toward the discharge sheet stacker 7, and then the motor is stopped. Thus, the reuse sheets 100 with the image on both sides are accumulated on the discharge sheet stacker 7 as non-reusable sheets. Accordingly, the operator can open the opening/closing door provided to the side of the device frame 15 as described above, and remove the non-reusable sheets.

When the upper face of the reuse sheet 100 is recorded and the lower face is blank, the reverse rotations of the transporting motor 31 are stopped while the trailing edge of the reuse sheet 100 in the transporting direction being nipped by the transporting roller pair 28. Next, the solenoid 34 is turned on, the second and third flappers 27*b* and 27*c* are moved from the carry-out path guide position to the carry-in roller guide position, and the transporting motor 31 is driven forward. Thus, the third flapper 27*c* assists the loading edge of the reuse sheet 100 in the transportation direction to be nipped by the sheet carry-in roller pair 25. The sheet carry-in roller pair 25 carries the reuse sheet 100 onto the reuse sheet 100 loaded on the uppermost portion of the sheet loading table 70 (the state shown in FIG. 5(B)). Upon a sensor (not shown) disposed near the slave roller of the sheet carry-in roller pair 25 detecting the trailing end of the carried reuse sheet 100 in the transportation direction, the CPU stops the forward rotational driving of the transporting motor 31. Thus, the reuse sheet 100 on the reuse sheet stacker 120 with the image on the upper face and no image on the lower face is switched back through the sheet transporting path in the front/back reversing unit 6, and is loaded on the first sheet loading unit 4 with the image on the upper face thereof.

Figure 6B:
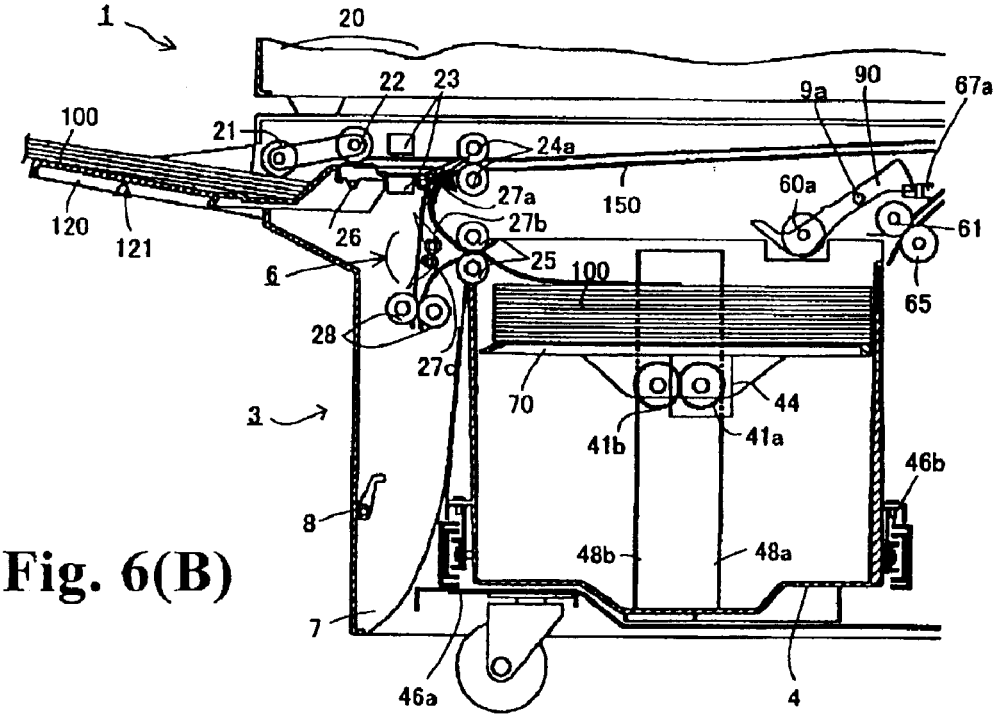

As shown in FIGS. 6(A) and 6(B), when the lower face of the reuse sheet 100 is recorded and the upper face thereof is blank, the solenoid 33 is turned on so that the first flapper 27*a* moves from the carry-out path closing position to the horizontal guide closing position. The solenoid 34 is turned on, and the second and third flappers 27*b* and 27*c* are moved from the carry-out path guide position to the carry-in roller guide position. Also, the reverse driving force is transmitted from the transporting motor 31 to the driving roller of the sheet carry-in roller pair 26 through the reverse clutch. Thus, the second flapper 27*b* assists the leading edge of the reuse sheet 100 in he transporting direction to be nipped by the sheet carry-in roller pair 25. The sheet carry-in roller pair 25 carries the reuse sheet 100 onto the reuse sheet 100 loaded on the uppermost portion of the sheet loading table 10 (the state shown in FIG. 6(B)). As shown in FIG. 5(B), when the lower face of the reuse sheet 100 is recorded and the upper face thereof is blank, upon the sensor disposed near the slave roller of the sheet carry-in roller pair 25 detecting the trailing end of the carried reuse sheet 100 in the transportation direction, the CPU stops the reverse rotational driving of the transporting motor 31. Thus, the reuse sheet 100 on the reuse sheet stacker 120 with the image on the lower face and no image on the upper face thereof makes a U-turn through the sheet transporting path in the front/back reversing unit 6, and is loaded on the first sheet loading unit 4 with the upper face and lower face reversed.

These carry-in operations to the first sheet loading unit are repeated in the same way until the empty sensor 121 turns off, i.e. until there are no more sheets stacked on the reuse sheet stacker 120. Accordingly, the reuse sheets 100 with the front side and backside aligned are stacked on the first sheet loading unit 4.

Operation of Supplying the Sheets to the Photocopier

When sheet supply instruction signals are received from an control unit (not shown) of the photocopier main unit 1, the CPU determines whether the instruction is an instruction for supplying the reuse sheets 100 loaded on the first sheet loading unit 4, or for supplying the unused sheets 110 loaded on the second sheet loading unit 5.

When it is the instruction for supplying the unused sheets 110, the supply motor 30*b* is driven. Accordingly, the uppermost unused sheet 110 on the second sheet loading unit 5 is fed out by the feeding roller 60*b*. Then, the unused sheet 110 is separated one at a time by the supply roller 62 and separating roller 66, and is transported toward downstream (upward).

When the resist sensor 68 detects the leading edge of the unused sheet 110 in the transporting direction, the CPU determines whether the supply motor 30*b* transports the unused sheet 110 by a predetermined number of steps. If it is not the case, the transpiration of the unused sheet 110 is continued. Thus, the leading edge of the unused sheet 110 in the transportation direction abuts against the resister roller pair 24*c* and is curved, thereby correcting skew occurred in the sheet supply guide 81. On the other hand, if it is the case, the skew of the unused sheet 110 is corrected, so the supply motor 32 is driven. The above-described connection clutch is engaged so as to transmit the driving force of the supply motor 32 to the resister roller pair 24*c*. Accordingly, the resister roller pair 24*c* supplies the unused sheet 110 within the sheet supply guide 81 toward the sheet transporting guide 50.

The unused sheet 110 carried into the photocopier main unit 2 is transported in a generally horizontal direction by a transporting roller pair on the sheet transporting path, and is pressed between the photosensitive drum and transfer roller so as to form a toner image. After the toner image is heated and fixed by the fixer, the sheet is discharged from the photocopier main unit 2.

When the instruction is for supplying the reuse sheets 100, it is determined whether the first sheet loading unlit carries the sheet based on whether the empty sensor 121 is on and the feeding roller position sensor 67*a* is off. If it is the case, the uppermost (next) reuse sheet 100 on the reuse sheet stacker 120 is temporarily stopped at the point that the sensor (not shown) placed near the slave roller of the sheet carry-in roller 25 detects the trailing edge of the reuse sheet 100 in the transporting direction. The elevating motor 44 drives the elevating gears 41*a* and 41*b* in the arrow direction in FIG. 2 until the uppermost reuse sheet 100 on the sheet loading table 70 abuts against the feeding roller 60*a*, and the feeding roller position sensor 67*a* turns on. Thus, the reuse sheet 100 can be supplied from the first sheet loading unit 4.

Next, the CPU drives the supply motor 30*a* and the supply motor 32. Thus, the feeding roller 60*a* feeds out the uppermost reuse sheet 100 on the first sheet loading unit 4, which is separated one at a time by the supply roller 61 and separating roller 65, and the separated reuse sheet 100 is transported toward downstream in the sheet supply direction.

When the transmitting integral sensor disposed at downstream of the transporting roller pair 24*b* detects the leading edge of the reuse sheet 100 in the sheet supply direction, the CPU judges whether the supply motor 32 rotates by the first predetermined number of steps in order to determine a marking position. If it is not the case, the transportation of the reuse sheet 100 is continued. On the other hand, if it is the case, the stamp motor 35 is driven by a predetermined number of steps. Thus, the upper face of the reuse sheet 100 (i.e., the face thereof already recorded upon) is marked as shown in FIG. 3.

Also, the CPU judges whether the supply motor 32 transports the reuse sheet 100 by the second predetermined number of steps (wherein the second number of steps is greater than the first number of steps). If it is not the case, the transportation of the reuse sheet 100 is continued. Thus, the leading edge of the reuse sheet 100 in the transportation direction abuts against the resister roller pair 64 and is curved, thereby correcting skew occurred in the sheet supply guide 80. On the other hand, if it is the case, the skew of the reuse sheet 100 is corrected, so the driving force of the supply motor 32 is transmitted to the resister roller pair 64 through the connection clutch. Accordingly, the resister roller pair 64 transports the reuse sheet 100 toward the sheet transporting guide 50.

Next, the CPU judges whether the supply motor 32 rotates by the third predetermined number of steps (wherein the third number of steps is greater than the second number of steps), i.e. whether the trailing edge of the reuse sheet 100 in the transporting direction is transported toward downstream from the resister roller pair 64. If it is not the case, the transportation of the reuse sheet 100 is continued. If it is the case, the stamp motor 35 is driven in reverse by a predetermined number of steps so as to return the marker 10*a* to the home position in preparation for marking the next reuse sheet 100, and then stopped. At this time, the marker 10*a* is returned to the home position with the opening/closing plate thereof closed by claws formed on the marker receptacle.

The reuse sheet 100 carried into the photocopier main unit 2 is transported in a converted horizontal direction by a transporting roller pair on the sheet transporting path, and is pressed between the photosensitive drum and transfer roller so as to form a toner image thereupon. After the toner image is heated and fixed by the fixer, the sheet is discharged from the photocopier main unit 2. The one face of the reuse sheet 100 discharged from the photocopier main unit 2 has the mark applied by the stamp unit 10 of the sheet supply unit 3, thereby preventing mixing the face having the image formed by the photocopier main unit 2 with the face the image already formed.

The operation of supplying the sheets to the photocopier main unit is performed for the number of sheets contained in the sheet supply instruction signals. The number of unused sheets 110 or reuse sheets 100 that the operator of the photocopier main unit 2 instructs from the operating unit are supplied one at a time to the photocopier main unit 2. When the operation of supplying the number of sheets contained in the sheet supply instruction signals is completed, the temporarily interrupted operation of carrying the sheet to the first sheet loading unit 4 is resumed.

Operation of Replenishing/Exchanging the Sheets

When the door open/close sensor detects that the front opening/closing door is opened, the CPU controls the power source unit so as to stop supplying electric power to components other than the CPU block and elevating motors 44, 45, in order to ensure safety for the operator. Thus, even in an event that such actions as carrying in the sheets to the first sheet loading unit and supplying the sheets to the photocopier main unit are being undertaken, the operations are temporarily interrupted. The CPU stores values for the states of each component during the interruption in the RAM, in preparation for restarting.

In this state, the operator pulls the first and second sheet loading units 4 and 5 in a direction toward the near side in FIG. 1, and presses a switch button disposed on the motor supporting member, thereby lowering the sheet loading tables 70 and 71. Thus, the operator can perform batch replenishing of the unused sheets 110 to the second sheet loading unit 5, or exchange the reuse sheets 100 and unused sheet 110 loaded on the first and second sheet loading units 4 and 5, between the first and second sheet loading units 4 and 5. Also, the safety of the operator is ensured, so the operator can also deal with any jamming that occurs, and so forth. In the event that repair is necessary for any of the mechanism or the control unit or the like, a main switch (not shown), which turns on or off the supply of commercial AC power to the power source, is first turned off in order to further ensure safety for the operator.

When the loading unit position detecting sensor detects the home position of the first and second sheet loading units 4 and 5, and the door open/close detecting sensor detects that the front opening/closing door is closed, the CPU drives the elevating motors 44 and 45 so that the elevating gears 41*a* and 41*b* shown in FIG. 2 rotate in the arrow directions in order to raise the sheet loading tables 70 and 71 to a height where the uppermost sheet on each of the tables contacts the feeding rollers 60*a* and 60*b*. Then, it is determined whether the feeding roller position sensors 67*a* and 67*b* detect an on state. If it is not the case, the rotational driving of the elevating motors 44 and 45 is continued, and if it is the case, the rotational driving of the elevating motors is stopped.

The CPU then reads out the values for the states of each component stored in the PAM during the interruption, and the actions taken before the interruption are resumed. In the event that the carry-in operation is interrupted while carrying in the sheets to the first sheet loading unit 4, the sheet loading table 70 is lowered by a predetermined amount as described, and subsequent actions are carried out.

Next, the advantages of the present embodiment will be described. The photocopier 1 according to the present embodiment has a feeding roller 60*a*, supply roller 61, and separating roller 65, each disposed toward the leading edge side of the first sheet loading unit 4 in the direction of transporting sheets, and a sheet carry-in roller pair 25 at the trailing edge side of the first sheet loading unit 4 in the direction of transporting sheets. Accordingly, unused sheets 110 are carried into and supplied from the first sheet loading unit 4 in one direction only. Hence, the carry-in direction and supply direction for reuse sheets are not opposite directions as with the conventional art, but are the same direction, so carrying in and supplying of reuse sheets can be performed smoothly and speedily.

Also, the photocopier 1 according to the present embodiment has slide guides 46*a*, 46*b*, 47*a*, and 47*b*, which contact the inner side and outer side of slide guide rails supported by the device frame 15 fixed at a lower position on both sides of the first and second sheet loading units 4 and 5, respectively, so the operator is capable of pulling the first and second sheet loading units 4 and 5 out in a direction toward the operating unit side of the photocopier main unit 2 which is a direction generally orthogonal to the sheet supply direction. There is enough space on the operating side of the photocopier 1 for the operator to operate the operating unit of the photocopier 1. Accordingly, the operator can easily and speedily perform batch replenishing of unused sheets 110 and replacing of unused sheets 110 and reuse sheets 110 loaded on the first and second sheet loading units 4 and 5.

Further, with the photocopier 1 according to the preset embodiment, the stacking unit of the reuse sheet stacker 120 is exposed from the device frame 15. Accordingly, space for the sheet stacker upon which reuse sheets are accumulated in conventional arrangements is no longer necessary, so the size of the sheet supply apparatus 3, and consequently the photocopier 1, can be reduced.

Also, with the photocopier 1 according to the preset embodiment, the CPU selectively reverses the front side and backside of the reuse sheets 100 by controlling the front/back reversing unit 6 between the detection sensor 23 and the sheet carry-in roller pair 25, according to the detection results of the reuse sheet 100 by the detection sensor 23. Accordingly, the blank sides (reusable sides) of the reuse sheets 100 loaded on the first sheet loading unit 4 are aligned.

Further, with the photocopier 1 according to the preset embodiment, the sheet reversing path of the front/back reversing unit 6 is situated above the first sheet loading unit 4, with the reversal actions of the reuse sheets 100 being performed above the first sheet loading unit 4 and the reuse sheets 100 supplied from the first sheet loading unit 4 being supplied through the sheet supply guide 80 disposed above the second sheet loading unit 5, so the size of the photocopier 1 in the sideways direction can be kept from becoming too large.

Further, with the photocopier 1 according to the preset embodiment, of the first and second sheet loading units 4 and 5, the reuse sheets 100 stacked on the reuse sheet stacker 120 are carried into the first sheet loading unit 4 which is closer to the reuse sheet stacker 120. Accordingly, the sheet carrying path from the reuse sheet stacker 120 to the first sheet loading unit 4 is reduced in length, so the occurrence of jamming in the carrying path can be suppressed.

Further, with the photocopier 1 according to the preset embodiment, the elevating motors 44 and 45 lower the sheet loading tables 70 and 71 by a predetermined amount such that reuse sheets 100 can be carried in, in the event that an empty sensor 121 detects the existence of reuse sheets 100, and the feeding roller 60*a* is not operating. Accordingly, carrying in sheets from the reuse sheet stacker 120 to the first sheet loading unit 4 is performed when the feeding roller 60*a* is not operating, so no operating error occur between the carrying in and supplying of the reuse sheets 100, thereby ensuring reliability.

The present embodiment further has the following advantages. The photocopier 1 according to the present embodiment selectively reverses the front and back sides of the reuse sheets 100 stacked on the reuse sheet stacker 120 with the front/back reversing unit 6 while confirming the front and back sides of the reuse sheets 100 with the detecting sensor 23 and loads the reuse sheets on the first sheet loading unit 4, and feeds the reuse sheets 100 out from the first sheet loading unit 4 with the feeding roller 60*a* so as to be supplied to the photocopier main unit 2. Accordingly, reuse sheets 100 and unused sheets 110 can be supplied from the sheet supply apparatus 3 to the photocopier main unit 2 with no need to change the interior configuration of the photocopier main unit 2 as with the conventional art, but only changing the interior structure of the sheet supply apparatus 3.

Also, with the photocopier 1 according to the present embodiment, the front/back reversing unit 6, detection sensor 23, sheet supply unit 20, and reuse sheet stacker 120 are disposed on that order at the rear side of the first sheet loading unit 4 in the direction of transporting sheets, so the overall sheet supply apparatus 3 can be configured in a compact manner even with sheet sorting functions. Moreover, with the photocopier 1 according to the present embodiment, the stacking unit of the reuse sheet stacker 120 is externally exposed from the sheet supply apparatus 3. Accordingly, reuse sheets 100 can be easily set without opening and closing the front opening/closing doors, and there is no need for the space within the sheet supply apparatus 3 for the reuse sheet stacker 120 required by the conventional art, so the sheet, supply apparatus 3, and consequently the photocopier 1, can be configured in a compact manner.

Also, with the photocopier 1 according to the present embodiment, the space below the side of the first sheet loading unit 4 between the reuse sheet stacker 120 and the first sheet loading unit 4 is effectively used to dispose the discharge sheet stacker 7, and sheets which have been recorded on both sides are dropped thereupon by the carry-out roller pair 28 disposed below the sheet carry-out path of the reversal carry-out guide 160, so the reuse sheets 100 and the sheets recorded on both sides (i.e., non-reusable) are sorted and the sheets recorded on both sides are accumulated separately, with the sheets recorded on both sides being discharged from a side opening/closing door, whereby space necessary for the discharge sheet stacker 7 can be minimized as suitable, and the size of the sheet supply apparatus 3 can be reduced.

Also, with the photocopier 1 according to the present embodiment, the reversal assistance guide 150 and the reversal carry-out guide 160 of the front/back reversing unit 6 for reuse sheets 100 are disposed in the space above and to the side of the front/back reversing unit 6, so the sheet supply apparatus 3 can be reduced in size even further. Further, with the photocopier 1 according to the present embodiment, the first and second sheet loading units 4 and 5 are placed side by side, so the height-wise dimensions of the sheet supply apparatus 3 can be reduced.

Moreover, the present embodiment has the following advantages. With the photocopier 1 according to the present embodiment, the recorded face (used face) of reuse sheets 100 supplied from the first sheet loading unit 4 are marked with the stamp unit 10 disposed in the sheet supply guide 80, thereby preventing the operator from mixing up the face with images already recorded thereupon with the face with images newly recorded thereupon with the photocopier main unit 2.

In this case, disposing the stamp unit 10 on he opposite side across the first sheet loading unit 4 (on the sheet supply guide 80 side) allows the overall sheet supply apparatus 3 to be reduced in size, and consequently, in weight.

Further, the device frame 15 of the sheet supply apparatus 3 according to the present embodiment has an installation face for placing the photocopier main unit 2, and the sheet supply apparatus 3 serves as the placement base for the photocopier main unit 2, so the footprint of the photocopier 1 (i.e. the sheet supply apparatus 3 and the photocopier main unit 2) can be reduced.

Also, while an example has been illustrated with the present embodiment wherein the detection sensor 23 detects the trailing edge of the reuse sheet 100 in the direction of transportation, an arrangement may be made wherein a transmission integral type detection sensor, for example is disposed between the detection sensor 23 and the transporting roller pair 24*a*, so as to detect the trailing edge of the reuse sheet 100 in the direction of transportation with this detection sensor. This reduces the load on the CPU calculating the number of pixels in parallel.

Also, while an example has been illustrated with the present embodiment wherein an electric reversal clutch or connection clutch is used for rotating the sheet carry-in roller pair 25 in the same direction, a mechanical structure formed as a combination of a one-way clutch and gear, or cams and gears, etc., may be used.

Further, an example has been illustrated with the present embodiment wherein, in the event that both sides of the reuse sheet 100 has been recorded upon, the first flapper 27*a* moves to the horizontal guide closing position, the second and third flappers 27*b* and 27*c* are maintained in the carry-out path guide position, and in this state, the transporting motor 31 is reverse-driven so that the reuse sheet 100 is dropped onto the discharge sheet stacker 7, as with cases wherein the upper face of the reuse sheet 100 has been recorded upon and the lower face thereof is blank; however, a reuse sheet with both sides recorded upon can be dropped on the discharge sheet stacker 7 by transporting motor 31 being reverse-driven even in the event that the second and third flappers 27*b* and 27*c* are maintained in the carry-out path guide position in the state shown in FIG. 6(B).

Also, with the present embodiment, an example has been illustrated wherein reuse sheets 100 are loaded on the first sheet loading unit 4 and unused sheets 110 are loaded on the second sheet loading unit 5, to facilitate description, but it is needless to say that the present invention is by no means restricted to this arrangement.

Also, while an example has been illustrated with the present embodiment wherein the components are controlled with the control unit on the sheet supply apparatus 3 side, an arrangement may be made wherein the components are controlled with the control unit on the photocopier main unit 2 side.

Next, the second embodiment, wherein the present invention is applied to a photocopier, will be described. With the present embodiment, a different reversal method is used for the front/back reversing unit 6, as well as the stamp unit being disposed upstream from the first sheet loading unit 4. Note that with the present embodiment and the following embodiments, the members same as those in the first embodiment will be denoted with the same reference numerals. Thus, description thereof will be omitted, and only different portions will be described.

Figure 7:
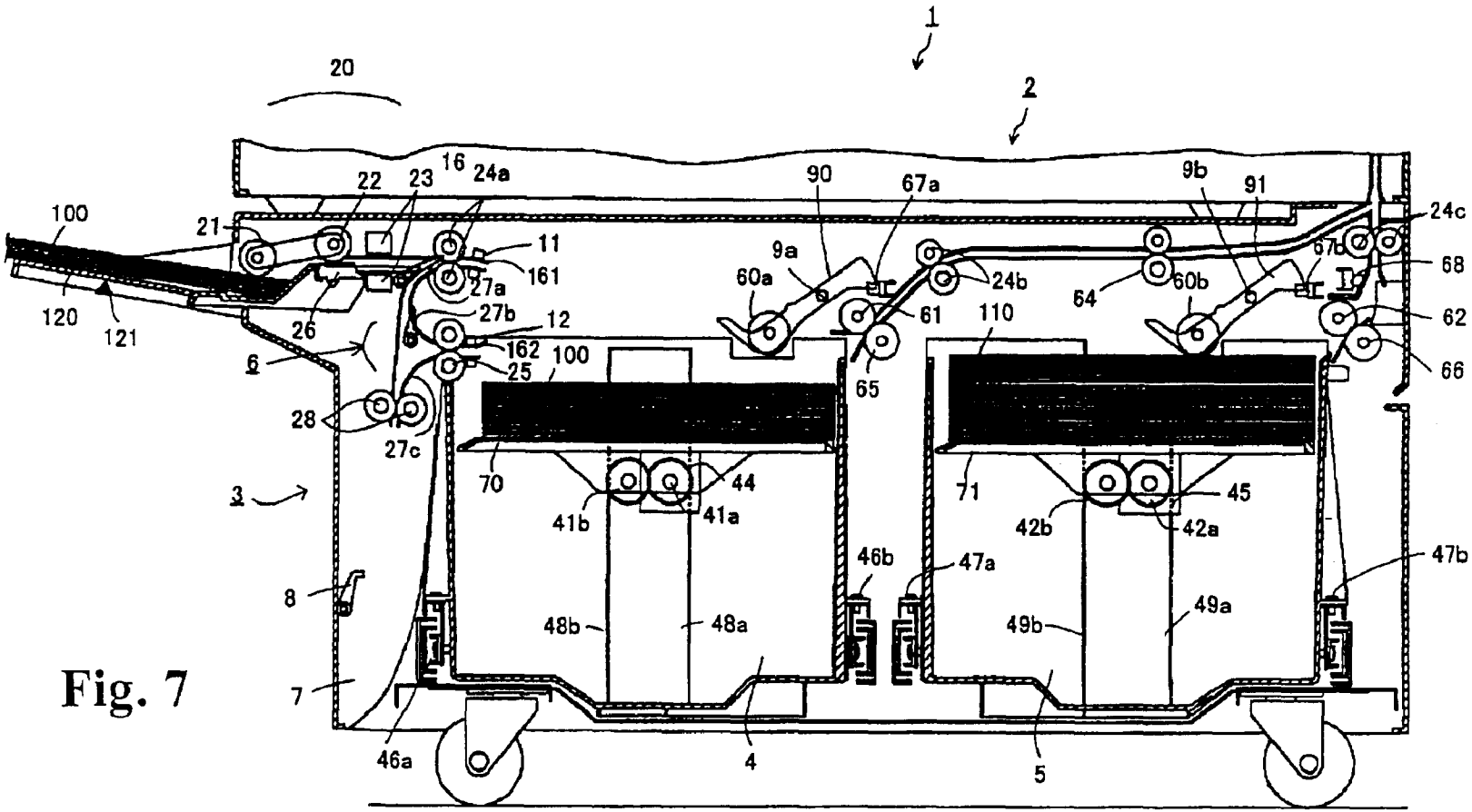
FIG. 7 is a sectional view showing a photocopier according to the second embodiment to which the present invention is applicable.

As shown in FIG. 7, the front/back reversing unit 6 according to the present embodiment is provided with an assistance guide 161 instead of the reversal assistance guide 150 according to the first embodiment. The assistance guide 161 is connected to the horizontal guide 16 and is shorter than the reversal assistance guide 150, and inclines downwards somewhat. A stamp unit 11 is fixed on the assistance guide 161.

Also, an assistance guide 162 having approximately the same length as the assistance guide 161 is disposed in a generally horizontal direction for the sheet carry-in roller pair 25, the assistance guide 162 being connected to the second and third guide piece of the reversal carry-out guide 160. A stamp unit 12 is fixed on the assistance guide 162. The stamp units 11 and 12 are driven by a stamp motor 36 formed of a stepping motor (not shown) capable of being rotated forwards or backwards.

Further, the front/back reversing unit 6 according to the present embodiment does not have the third flapper 27*c* shown in the first embodiment, and the stamp unit is absent from the path of the sheet supply guide 80.

Figure 8A:
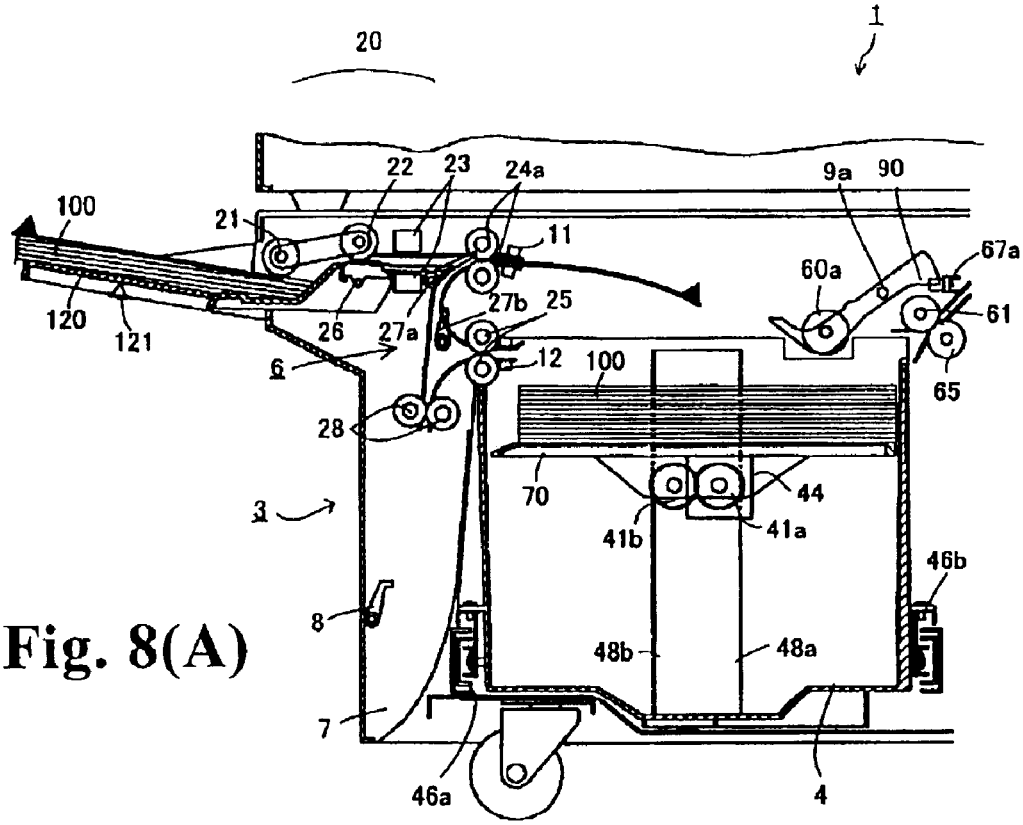
Figure 8B:
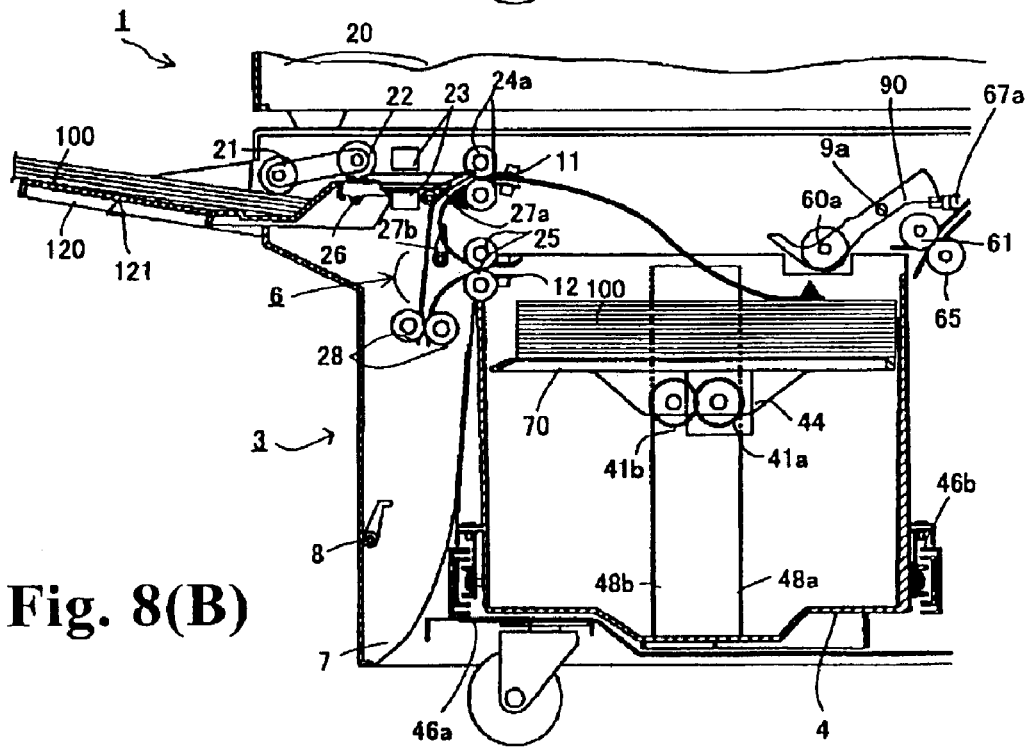

With the photocopier 1 according to the present embodiment, as shown in FIG. 8(A), in the event that the upper face of the reuse sheet 100 has already been recorded upon and the lower face thereof is blank, the CPU effects control wherein the solenoids 33 and 34 are left off so that the first flapper 27*a* remains in the carry-out path closing position and the second flapper 27*b* is maintained in the transporting path guide position, and in this state, the stamp motor 36 is driven so as to run the stamp unit through a gear omitted in the drawings. Thus, the upper face of the reuse sheet 100 is marked, and carried into and deposited upon the uppermost reuse sheet 100 loaded on the sheet loading table 70 (see FIG. 8B). At the point that the reuse sheet 100 is stacked on the sheet stacking table, the stamp motor 36 is reverse-driven so as to return the marker of the stamp unit 11 to the home position in preparation for marking the next reuse sheet 100, following which the stamp motor 36 is stopped.

Figure 9A:
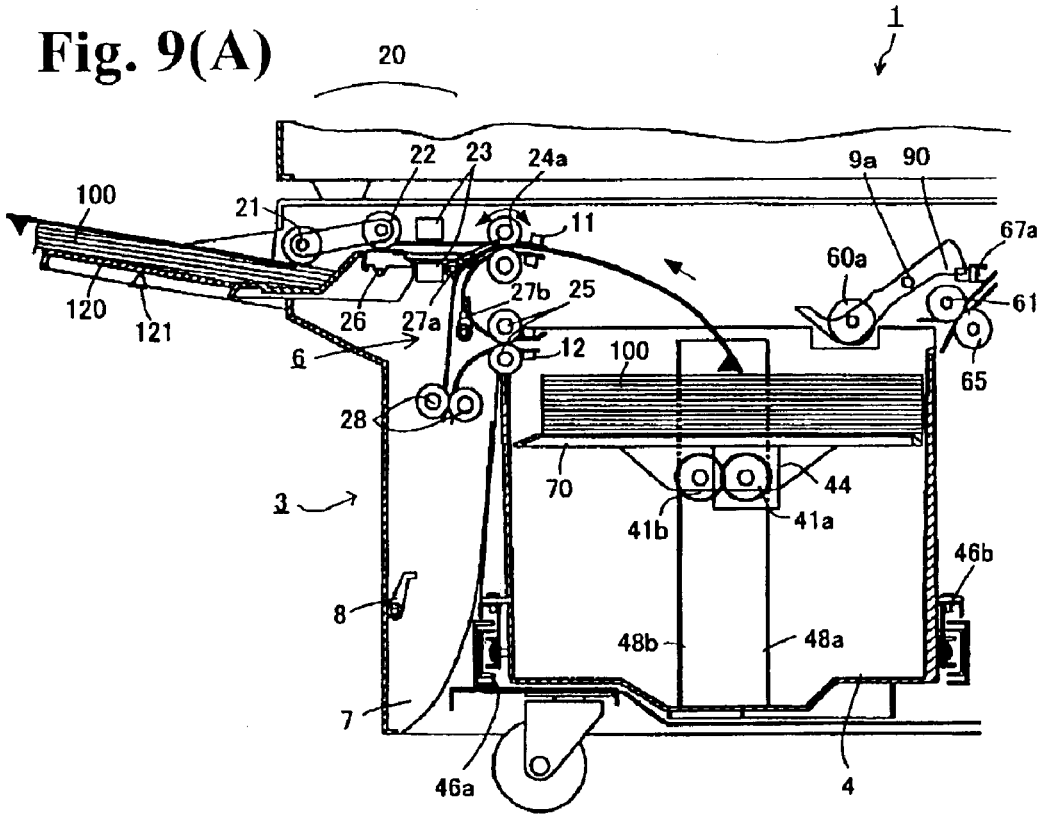
Figure 9B:
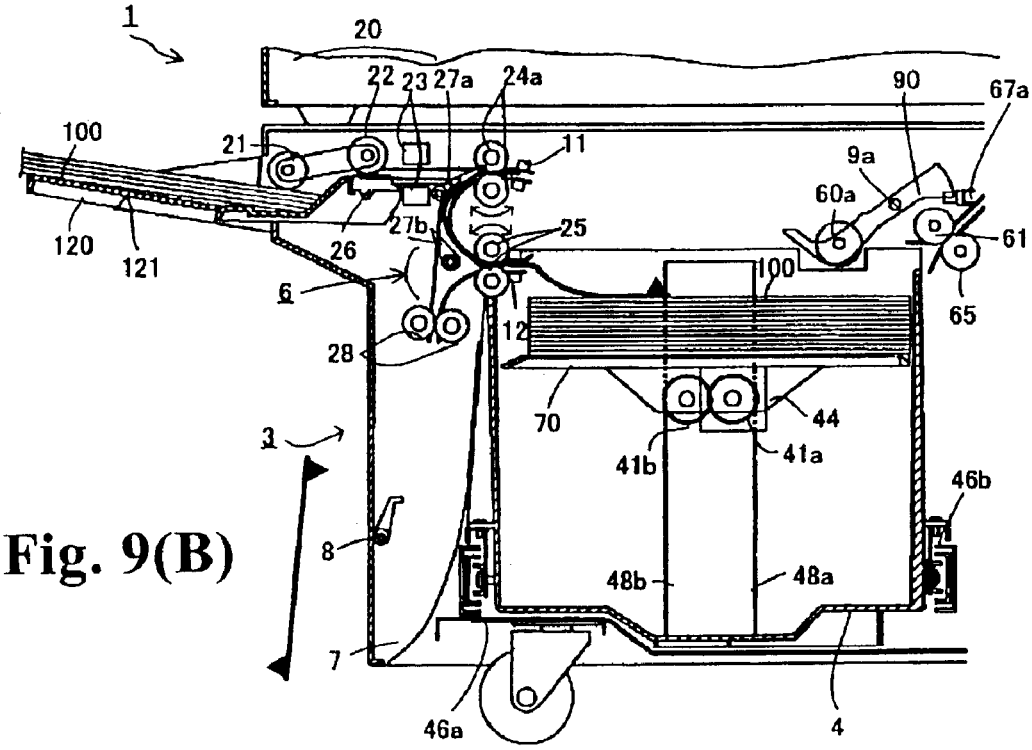

As shown in FIG. 9(A), in the event that the upper face of the reuse sheet 100 has be recorded upon and the lower face is blank, the transporting motor 31 is driven, and the reverse rotations of the transporting motor 31 are stopped with the trailing edge of the reuse sheet 100 in the transporting direction being nipped by the transporting roller pair 24*a*. Next, the solenoid 33 is turned on, the first flapper 27*a* is moved to the horizontal guide closing position, the second flapper 27*b* is moved from the carry-out path guide position to the carry-in roller guide position, and the transporting motor 31 is reverse-driven. Thus, the driving force of the transporting motor 31 is transmitted to the sheet carry-in roller pair 25 through the reversal clutch, and the first and second flappers 27*a* and 27*b* assist the leading edge of the reuse sheet. 100 in the direction of transportation so as to be nipped by the sheet carry-in roller pair 25. Upon the reuse sheet 100 being nipped by the sheet carry-in roller pair 25, the stamp motor 36 is driven so as to run the stamp unit 12 through a gear omitted in the drawings. Thus, the upper face of the reuse sheet 100 is marked and the front and back sides thereof are reversed, and carried into and deposited upon the uppermost reuse sheet 100 loaded on the sheet loading table 70 (see FIG. 9(B)). At the point that the reuse sheet 100 is stacked on the sheet stacking table, the stamp motor 36 is reverse-driven so as to return the marker of the stamp unit 12 to the home position in preparation for marking the next reuse sheet 100, following which the stamp motor 36 is stopped.

In the event that both sides of the reuse sheet 100 have been recorded on, the transporting motor 31 is driven, and the reverse rotations of the transporting motor 31 are stopped with the trailing edge of the reuse sheet 100 in the transporting direction being nipped by the transporting roller pair 24*a*. Next, the solenoids 33 and 34 are turned on so that the first flapper 27*a* is at the horizontal guide closing position and the second flapper 27*b* is moved from the carry-out path guide position to the carry-in roller guide position. Then, the transporting motor 31 is reverse-driven a number of steps sufficient for the trailing edge of the reuse sheet 100 in the transportation direction to come loose from the nipping of the carry-out roller pair 28 and fall toward the discharge sheet stacker 7, and then stopped. Thus, the reuse sheets 100 which have been recorded on both sides are accumulated on the discharge sheet stacker 7.

With the photocopier 1 according to the present embodiment, the number of switchbacks in the transporting (reversal) method performed by the front/back reversing unit 6 upon a reuse sheet 100 which is blank on one side or the other is placed on the reuse sheet stacker 120, is none or once. Conversely, with the first embodiment, the number of switchbacks in the transporting (reversal) method required for the front/back reversing unit 6 to perform is once or twice with the reversal assistance guide 150 and the carry-out roller pair 28. Accordingly, the photocopier 1 according to the present embodiment is capable of loading the reuse sheets 100 in the first sheet loading unit 4 speedier than with the photocopier 1 according to the first embodiment.

Also, even in the event that the photocopier main unit 2 is a high-speed machine, the reuse sheets 100 are marked with the stamp units 11 and 12 before being loaded with the photocopier 1 according to the present embodiment, so the reuse sheets 100 can be supplied from the first sheet loading unit 4 serving as storage to the photocopier main unit 2 at a speed matching that of the photocopier main unit 2.

Next, the third embodiment, wherein the present invention is applied to a photocopier, will be described. With the present embodiment, a different reversal method is used for the front/back reversing unit 6, and the sheet accumulating unit is disposed in the vertical direction. The present embodiment is applicable to a photocopier main unit relatively smaller than the photocopier main unit in the previous embodiments.

Figure 10:
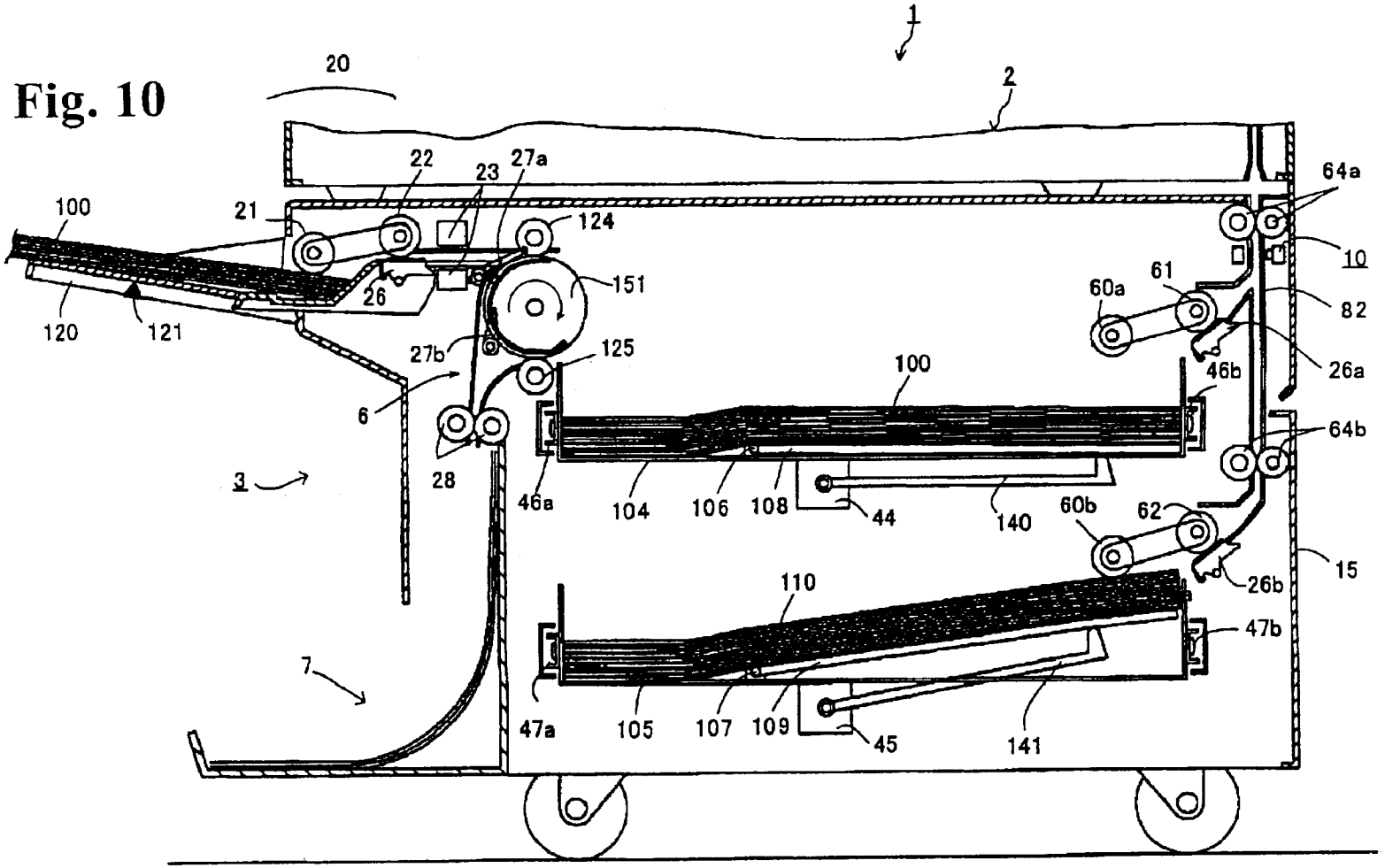
FIG. 10 is a sectional view showing a photocopier according to the third embodiment to which the present invention is applicable.

As shown in FIG. 10, the sheet supply apparatus 3 according to the present embodiment comprises within a device frame 15, a first tray 104 upon which primarily reuse sheets 100 are loaded, and a second tray 105 disposed below the first tray 104 upon which primarily unused sheets 110 are loaded.

The first and second trays 104 and 105 have on the bottom portions thereof supply inclined plates 108 and 109 for supplying sheets loaded which are axially supported by the trays and are rotatable on inclined axes 106 and 107. Elevating motors 44 and 45 for inclining the supply inclined plates 108 and 109 are fixed on the bottom of the first and second trays 104 and 105. On the motor shafts of the elevating motors 44 and 45 are fixed elevating levers 140 and 141 with generally L-shaped cross-sectional forms, with the tips thereof fixed to the base of the supply inclined plates 108 and 109 opposite to the inclined axes 106 and 107 across the positions where the elevating motors 44 and 45 are fixed.

Accordingly, driving the elevating motors 44 and 45 allows the sheet end portions at the tip side of the elevating levers 140 and 141 to be raised and lowered. Note that in FIG. 10, the first tray 104 is in a state wherein the reuse sheets 100 stacked on the reuse sheet stacker 120 can be carried in, and the second tray 105 is in a state wherein unused sheets 110 can be supplied by driving of the elevating motor 45.

Also, slide guides 46*a*, 46*b*, 47*a*, and 47*b*, which contact the inner side of slide guide rails having a C-channel cross-sectional shape and supported by the device frame 15, are fixed at a lower position on both sides of the first and second trays 104 and 105, respectively. Accordingly, the operator is capable of opening the above-described front opening/closing doors and pulling each of the first and second trays 104 and 105 out toward the near side in FIG. 10, as with the first embodiment.

A large-diameter reversal roller 151 rotatably axially supported by the device frame 15 is provided to the front/back reversing unit 6 in the present embodiment instead of the transporting roller pair 24*a* and sheet carry-in roller pair 25 in the first embodiment, with slave rollers 124 and 125 being pressed against the reversal roller 151. Rotational driving force is supplied to the reversal roller 151 from the transporting motor 31. Also, the arrangement comprises a short guide piece communicating with the upper side guide piece on the horizontal guide 16, instead of the reversal assistance guide 150. Further, the front/back reversing unit 6 in the present embodiment is configured without the third flapper 27*c* shown in the first embodiment. A reversal clutch such as with the first embodiment is not provided to the roller shaft of the reversal roller 151.

Also, in order to reduce the size of the sheet supply apparatus 3, the partition plate 14 of the first embodiment is omitted, and the discharge sheet stacker 7 is formed of a side plate of the device frame 15 bent downwards under the reuse sheet stacker 120 in a generally L-shaped cross-sectional form, and a side plate extended downward from the reuse sheet stacker 120 partway (to around above the second tray 105) in a general dogleg shape.

On the other hand, a sheet supply guide 82 extended in a generally vertical direction is disposed on the opposite side of the front/back reversing unit 6 across the first and second trays 104 and 105. A feeding guide for guiding the reuse sheets 100 and the unused sheets 110 fed out from the first and second trays 104 and 105 merges with the sheet supply guide 82. A resister roller pair 64*b* for correcting skewing of the unused sheets 110 is provided downstream (upwards) from the point of merging of the feeding guide for the unused sheets 110, and a stamp unit 10 for marking the reuse sheets 100 and a resister roller pair 64*a* for correcting skewing of the reuse sheets 100 are provided downstream from the point of merging of the feeding guide for the reuse sheets 100, in that order.

Further, the sheet feeding mechanism according to the present embodiment employs a structure the same as the sheet supply unit 20 in the first embodiment, employing a kick roller 21, supply roller 22, and separating pad 26. That is to say, with the present embodiment, the kick roller 21 in the first embodiment corresponds to the feeding rollers 60*a* and 60*b* in the present embodiment, the supply roller 22 in the first embodiment corresponds to the supply rollers 61 and 62 in the present embodiment, and the separating pad 26 in the first embodiment corresponds to the separating pads 26*a* and 26*b* in the present embodiment.

Next, the operations of the photocopier 1 according to the present embodiment will be described. With the photocopier 1 according to the present embodiment, in the event that the upper face of the reuse sheet 100 has been recorded upon and the lower face is blank, the CPU turns the solenoids 33 and 34 off so that the first flapper 27*a* is maintained in the carry-out path closing position and the second flapper 27*b* is maintained in the transporting path guide position, and the transporting motor 31 is rotated forward so that the reversal roller 151 is rotated in the direction of the arrow shown in FIG. 10. Thus, the reuse sheet 100 nipped between the reversal roller 151 and slave roller 124 and transported is carried onto the uppermost reuse sheet 100 loaded on the first tray 104, and deposited there. It is needless to mention that before starting the above actions, the CPU runs the elevating motor 44 so that reuse sheets 100 stacked on the reuse sheet stacker 120 can be carried into the first tray 104, as shown in FIG. 10.

In the event that the upper face of the reuse sheet 100 has been recorded upon and the lower face is blank, the transporting motor 31 is driven, and the reverse rotations of the transporting motor 31 are stopped with the trailing edge of the reuse sheet 100 in the transporting direction being nipped by the transporting roller pair 24*a*. Next, the solenoid 34 is turned on, the first flapper 27*a* is moved to the horizontal guide closing position, the second flapper 27*b* is moved from the carry-out path guide position to the carry-in roller guide position, and the transporting motor 31 is reverse-driven. Thus, the reversal roller 151 rotates in reverse, and the first and second flappers 27*a* and 27*b* assist the leading edge of the reuse sheet 100 in the direction of transportation so as to be nipped by the reversal roller 151. The front and back sides of the reuse sheet 100 nipped between the reversal roller 151 and slave roller 125 are reversed, and the reuse sheet 100 is carried into and deposited upon the uppermost reuse sheet 100 stacked on the first tray 104.

In the event that both sides of the reuse sheet 100 have been recorded on, the transporting motor 31 is driven, and the reverse rotations of the transporting motor 31 are stopped with the trailing edge of the reuse sheet 100 in the transporting direction being nipped by the transporting roller pair 24*a*. Next, the solenoid 33 is turned on so that the first flapper 27*a* is positioned at the horizontal guide closing position. The solenoid 34 is left off so that the second flapper 27*b* is positioned at the carry-out path guide position. Then, the transporting motor 31 is reverse-driven a number of steps sufficient for the trailing edge of the reuse sheet 100 in the transportation direction to come loose from the nipping of the carry-out roller pair 28 and fall toward the discharge sheet stacker 7, and then stopped. Thus, the reuse sheets 100 which have been recorded on both sides are accumulated on the discharge sheet stacker 7. The supplying actions for the sheets are almost the same as those in the first embodiment, so description thereof will be omitted here.

With the photocopier 1 according to the present embodiment, a large-diameter reversal roller 151 is employed, so transportation (reversal) processing within the front/back reversing unit 6 can be performed at high speeds. Also, large-capacity sheet supply units (large-capacity trays, LCT) for loading the reuse sheets 100 and the unused sheets 110 are not used as with the first and second embodiments, but rather the first and second trays 104 and 105 are used, and further, the first and second trays 104 and 105 are overlaid vertically, hereby reducing the sideways dimensions of the sheet supply apparatus 3, and reducing the size of the photocopier 1. Also, the sheet transportation distance is shorter than with the first embodiment, so jamming of sheets in the transportation path can be further reduced.

While the invention has been explained with reference to the specific embodiments, the explanation is illustrative and the invention is limited only by the appended claims.

What is claimed is:

1. A sheet supply apparatus, comprising:

sheet loading means for loading a sheet;

sheet stacking means for stacking the sheet to be loaded on the sheet loading means;

sheet feeding means provided at a front end of the sheet loading means in a sheet supplying direction for feeding the sheet loaded on the sheet loading means;

sheet carrying means provided at a rear end of the sheet loading means in the sheet supplying direction for carrying the sheet stacked on the sheet stacking means into the sheet loading means;

first sheet detecting means for detecting whether an image is formed on at least one side of the sheet loaded on the sheet loading means; and supporting means attached to the sheet loading means for supporting the same to be extractable from the sheet supply apparatus.

2. A sheet supply apparatus according to claim 1, further comprising reversing means disposed between the first sheet detecting means and the sheet carrying means for selectively reversing the sheet according to a detection result of the first detecting means.

3. A sheet supply apparatus according to claim 2, wherein said reversing means further includes a sheet reversing path disposed above the sheet loading means.

4. A sheet supply apparatus according to claim 3, further comprising elevating means for raising and lowering the sheet loading means, and second detecting means for detecting whether the sheet is located on the sheet stacking means, said elevating means lowering the sheet loading means by a predetermined distance when the second detecting means detects the sheet and the sheet feeding means is not operating.

5. A sheet supply apparatus according to claim 3, wherein said sheet loading means includes a plurality of sheet loading means for loading the sheet, said sheet carrying means being arranged such that the sheet stacked on the sheet stacking means is carried into one of the sheet loading means arranged closer to the sheet stacking means among the plurality of the sheet loading means.

6. A sheet supply apparatus according to claim 5, further comprising elevating means for raising and lowering the sheet loading means, and second detecting means for detecting whether the sheet is located on the sheet stacking means, said elevating means lowering the sheet loading means by a predetermined distance when the second detecting means detects the sheet and the sheet feeding means is not operating.

7. An image forming apparatus for forming an image on a sheet, comprising said sheet supply apparatus according to claim 1, said sheet supply apparatus operating as a stacking base of the image forming apparatus, and said supporting means supporting the sheet loading means to be extractable at an operating side of the image forming apparatus in a direction perpendicular to the sheet supplying direction.

8. A sheet supply apparatus, comprising:

a plurality of sheet loading means for loading sheets;

sheet feeding means provided at a front side of the sheet loading means in a sheet supplying direction for feeding a sheet loaded on the sheet loading means;

sheet carrying means for carrying the sheet to one of the plurality of the sheet loading means;

stacker means for stacking the sheet to be carried by the sheet carrying means;

sheet supply means for supplying the sheet stacked on the stacker means;

detecting means disposed at a downstream side of the sheet feeding means in a sheet supplying direction for detecting whether a front or back side of the sheet is blank; and reversing means disposed on a sheet transporting path between the detecting means and the sheet carrying means for selectively reversing the sheet.

9. A sheet supply apparatus according to claim 8, wherein said stacker means, said sheet supply means, said detecting means, and said reversing means are disposed at a side of the sheet loading means.

10. A sheet supply apparatus according to claim 9, wherein said reversing means, detecting means, and sheet supply means are disposed in this order at a rear side of the sheet loading means opposite to a front side of the sheet supply means in the sheet supplying direction.

11. A sheet supply apparatus according to claim 9, further comprising supporting means for supporting the plurality of the sheet loading means so that the plurality of the sheet loading means can be inserted and extracted from the sheet supply apparatus in a direction perpendicular to the sheet feeding direction of the sheet feeding means.

12. A sheet supply apparatus according to claim 9, wherein said stacker means is disposed outside of the sheet supply apparatus, and said sheet carrying means carries the sheet into one of the sheet loading means arranged closer to the stacker means among the plurality of the sheet loading means.

13. A sheet supply apparatus according to claim 9, wherein said plurality of the sheet loading means is arranged in parallel laterally.

14. A sheet supply apparatus according to claim 9, wherein said plurality of the sheet loading means is arranged to overlap vertically.

15. A sheet supply apparatus according to claim 9, further comprising a discharge unit disposed at a side of the sheet loading means between the stacker means and the sheet loading means for discharging the sheet with images on both sides thereof.

16. A sheet supply apparatus according to claim 15, wherein said reversing means further includes a sheet reversing path formed above the sheet loading means, and said discharging means further includes a sheet discharging path formed at a side of the sheet loading means.

17. An image forming apparatus for forming an image on a sheet, comprising said sheet supply apparatus according to claim 8, said sheet supplying apparatus operating as a stacking base of the image forming apparatus, and a frame on which the plurality of the loading means, the sheet feeding means, the sheet carrying means, the stacker means, the sheet supply means, the detecting means and the reversing means are mounted.

18. An image forming apparatus for forming an image on a sheet, comprising said sheet supply apparatus according to claim 17, said sheet supplying apparatus operating as a stacking base of the image forming apparatus, and a frame on which the plurality of the loading means, the sheet feeding means, the sheet carrying means, the stacker means, the sheet supply means, the detecting means and the reversing means are mounted.

19. A sheet supply apparatus, comprising:

sheet loading means for loading a sheet;

sheet feeding means for feeding the sheet loaded on the sheet loading means;

supply means for supplying the sheet fed by the sheet feeding means to an image forming apparatus;

sheet carrying means for carrying the sheet to the sheet loading means;

stacker means for stacking the sheet carried by the sheet carrying means;

sheet supply means for supplying the sheet stacked on the stacker means;

first detecting means disposed at a downstream side of the sheet supply means for detecting whether at least one of a front and back side of the sheet is blank;

reversing means disposed between the detecting means and the sheet carrying means for selectively reversing the sheet, and transporting the sheet to the sheet carrying means; and marking means for providing a mark on one side of the sheet indicating that the one side is used.

20. A sheet transfer apparatus according to claim 19, wherein said loading means, said sheet feeding means, said supply means, said sheet carrying means, said sheet supply means, said first detecting means, said reversing means, and said marking means are disposed within the sheet supply apparatus.

21. A sheet supply apparatus according to claim 20, further comprising a sheet supply path disposed between the stacker means and the sheet loading means, said marking means being disposed on the sheet supply path.

22. A sheet supply apparatus according to claim 20, further comprising a sheet transporting path through which the supply means supplies the sheet, said marking means being disposed on the sheet supply path.

23. A sheet supply apparatus according to claim 20, further comprising elevating means for raising and lowering the sheet loading means, and second detecting means for detecting whether the sheet is located on the sheet stacking means, said elevating means lowering the sheet loading means by a predetermined distance when the second detecting means detects the sheet and the sheet feeding means is not operating.

24. A sheet supply apparatus for supplying a sheet to an image forming apparatus, comprising:

a plurality of sheet loading means for loading the sheets;

sheet feeding means for feeding the sheets loaded on the sheet loading means;

sheet carrying means for carrying a sheet to one of the plurality of the sheet loading means;

stacker means for stacking the sheet to be carried to the sheet loading means;

sheet supply means for supplying the sheet stacked on the stacker means;

detecting means disposed at a downstream side of the sheet supply means in a sheet supplying direction for detecting whether at least one of a front and back side of the sheet is blank;

reversing means disposed between the detecting means and the sheet carrying means for selectively reversing the sheet and transporting the sheet to the sheet carrying means; and marking means for providing a mark on one side of the sheet indicating that the one side is used;

wherein said stacker means, said sheet supply means, said detecting means, and said reversing means are disposed at one side of the sheet loading means, and said marking means is disposed at the other side of the sheet loading means.

25. A sheet supply apparatus according to claim 24, wherein said sheet carrying means carries the sheet into one of the sheet loading means arranged closer to the stacker means among the plurality of the sheet loading means.

26. A sheet supply apparatus for supplying a sheet to an image forming apparatus, comprising:

first and second sheet loading means arranged in parallel for loading sheets;

first and second sheet feeding means for feeding the sheets loaded on the first and second sheet loading means;

a sheet supply path arranged above the second sheet loading means for supplying the sheet fed by the first sheet feeding means to the image forming apparatus;

sheet carrying means disposed at an upstream side of the first sheet feeding means in a sheet supplying direction for carrying the sheet to the first sheet loading means;

stacker means for stacking the sheet to be carried to the first sheet loading means;

sheet supply means for supplying the sheet stacked on the stacker means;

detecting means disposed at a downstream side of the sheet supply means for detecting whether at least one of a front and back side of the sheet is blank;

reversing means disposed between the detecting means and the sheet carrying means for selectively reversing the sheet and transporting the sheet to the sheet carrying means; and marking means disposed on the sheet supply path for providing a mark on one side of the sheet fed from the first sheet loading means, indicating that the one side is used.

* * * * *

UNITED STATES PATENT AND TRADEMARK OFFICE

CERTIFICATE OF CORRECTION

PATENT NO. : 7,066,460 B2
APPLICATION NO. : 10/397238
DATED : June 27, 2006
INVENTOR(S) : Yusuke Asao It is certified that error appears in the above-identified patent and that said Letters Patent is hereby corrected as shown below:

Please change column 28, line 30, "sheet feeding means" to --sheet supply means--.

Signed and Sealed this

Ninth Day of February, 2010

David J. Kappos

David J. Kappos
*Director of the United States Patent and Trademark Office*